US007618381B2

(12) United States Patent
Krebs et al.

(10) Patent No.: US 7,618,381 B2
(45) Date of Patent: Nov. 17, 2009

(54) WRIST AND UPPER EXTREMITY MOTION

(75) Inventors: Hermano Igo Krebs, Cambridge, MA (US); Neville Hogan, Sudbury, MA (US); Dustin Williams, Cambridge, MA (US); James Celestino, South Amboy, NJ (US)

(73) Assignee: Massachusetts Institute of Technology, Cambridge, MA (US)

( * ) Notice: Subject to any disclaimer, the term of this patent is extended or adjusted under 35 U.S.C. 154(b) by 821 days.

(21) Appl. No.: 10/976,083

(22) Filed: Oct. 27, 2004

(65) Prior Publication Data

US 2006/0106326 A1 May 18, 2006

(51) Int. Cl.
*A61H 1/00* (2006.01)

(52) U.S. Cl. ..... 601/5; 602/16

(58) Field of Classification Search ..... 602/5, 602/16, 19, 20–23, 32; 128/846, 878–879; 692/5, 16, 19, 20–23, 32; 601/5
See application file for complete search history.

(56) References Cited

U.S. PATENT DOCUMENTS 4,885,687 A 12/1989 Carey
5,117,813 A 6/1992 Haxton et al.
5,170,777 A 12/1992 Reddy et al.
5,466,213 A 11/1995 Hogan et al.
5,695,431 A * 12/1997 Bond et al. ..... 482/1
5,830,160 A 11/1998 Reinkensmeyer
5,885,231 A 3/1999 Cramer et al.
5,951,499 A * 9/1999 Saringer et al. ..... 601/33
6,267,733 B1 7/2001 Peterson et al.
6,379,393 B1 * 4/2002 Mavroidis et al. ..... 623/25
6,743,187 B2 6/2004 Solomon et al.
6,880,487 B2 4/2005 Reinkensmeyer et al.
7,367,958 B2 * 5/2008 McBean et al. ..... 602/16
2004/0243025 A1 12/2004 Peles
2004/0243027 A1 12/2004 Hook
2004/0267331 A1 12/2004 Koeneman et al.
2006/0069336 A1 3/2006 Krebs et al.
2007/0138886 A1 6/2007 Krebs et al.
2007/0270723 A1 11/2007 Krebs et al.

OTHER PUBLICATIONS

Burgar et al., "Development of Robots for Rehabilitation Therapy: The Palo Alto VA/Stanford Experience," *Journal of Rehabilitation Research and Development*, vol. 37, No. 6, Nov./Dec. 2000.

Celestino et al., "A Robot for Wrist Rehabilitation: Characterization and Initial Results", *ICORR*, Korea (2003).

Deutsch et al., "Rehabilitation of Musculoskeletal Injuries Using the Rutgers Ankle Haptic Interface: Three Case Reports," *EuroHaptics Conference*, Jul. 1-4, 2001, Fig. 1, p. 1, col. 2, para. 5 to p. 2, col. 1, para. 1.

(Continued)

*Primary Examiner*—Michael A. Brown
(74) *Attorney, Agent, or Firm*—Scott E. Kamholz; Foley Hoag LLP

(57) ABSTRACT

Wrist and upper extremity motion systems and method may include positioning a subject's wrist or upper extremity in a motion device, and actuating one or more motors associated with the device to provide at least one of assistance, perturbation, and resistance to a wrist or upper extremity motion.

48 Claims, 20 Drawing Sheets

OTHER PUBLICATIONS

Krebs et al., "Rehabilitation Robotics: Pilot Trial of Spatial Extension for MIT-MANUS," Oct. 25, 2004, *Journal of NeuroEngineering and Rehabilitation*, Oct. 26, 2004, 1:5, pp. 1-15.

Krebs et al., "A Wrist Extension of MIT-MANUS," *Allemagne*, "Advances in Rehabilitation Robotics: Human-Friendly Technologies on Movement Assistance and Restoration for People With Disabilities," Springer, Berlin, 2004/1977, vol. 306, pp. 377-390.

Krebs et al., "Notes on Rehabilitation Robotics and Stroke," In. F. Lofaso, A. Roby-Brami, J.F. Ravaud (Eds.); *Technological Innovations and Handicap*, Frison Roche 2004.

Volpe, B.T., Ferraro, M., Lynch, D., Christos, P., Krol, J., Trudell, C., Krebs, H.I., Hogan, N.; "Robotics and Other Devices in the Treatment of Patients Recovering from Stroke," *Current Atherosclerosis Reports*, 6:314-319 (Jul. 2004).

Volpe B.T., Shelton F, Krebs HI, Hogan N, Diels C, Reding M. "Dextroamphetamine paired with standard and robotic neurorehabilitation changes motor performance one day later." *Ann Neurol*. 2000; 48: 454.

Volpe, Bruce T., "Stroke, Stroke": A Coxswain's Call for More Work and More Innovation, *Journal of Rehabilitation Research & Development*, vol. 41, No. 3a, May/Jun. 2004, pp. vii-x.

Williams, D.J.; Krebs, H.I.; Hogan, N., "A Robot for Wrist Rehabilitation," *IEEE—23rd EMBS*; Oct. 2001.

Williams, Dustin, "A Robot for Wrist Rehabilitation," Masters Thesis, Department of Mechanical Engineering, Massachusetts Institute of Technology, Jun. 2001.

International Search Report for PCT/US2005/39001.

* cited by examiner

WRIST AND UPPER EXTREMITY MOTION

BACKGROUND

Neurological trauma, orthopedic injury, and joint diseases are common medical problems in the United States. A person with one or more of these disorders may lose motor control of one or more body parts, depending on the location and severity of the injury. Recovery from motor loss frequently takes months or years, as the body repairs affected tissue or as the brain reorganizes itself. Physical therapy can improve the strength and accuracy of restored motor function and can also help stimulate brain reorganization. This physical therapy generally involves one-on-one attention from a therapist who assists and encourages the patient through a number of repetitive exercises. The repetitive nature of therapy makes it amenable to administration by properly designed robots.

Existing devices for physical therapy are by and large CPM (continuous passive motion) machines. CPM machines have very high mechanical impedance and simply move the patient passively through desired motions. These devices might be useful to extend the range of motion. However, because these systems do not allow for impedance variation, patients are not encouraged to express movement on their own.

SUMMARY

The disclosed subject matter relates to devices to be attached to the wrist and/or upper extremity of a subject for a variety of purposes. In some embodiments, the devices have low mechanical impedance to permit fine motor rehabilitation.

In an embodiment, a wrist attachment may include a forearm support, so sized and shaped as to be able to receive a forearm of a subject. The forearm support can define a long axis of the attachment. A handle may be so positioned in relation to the forearm support and so sized and shaped as to be able to receive a hand. The handle may have at most five degrees of freedom with respect to the forearm support. The wrist attachment may further include a transmission system providing rotation with three degrees of freedom.

In another embodiment, a method of wrist training may include lowering a subject's forearm onto the forearm support of a wrist attachment and aligning the subject's wrist flexion axis with the FE axis of the wrist attachment. The subject's hand may be contacted to the handle of the wrist attachment, and at least one of the subject's upper arm, forearm, wrist, and hand may be secured to the wrist attachment. The transmission system of the wrist attachment may be actuated to provide at least one of assistance, perturbation, and resistance to a wrist motion.

DETAILED DESCRIPTION

The wrist and upper extremity attachments described here can be used to provide physical therapy to a subject. In particular, the wrist attachment includes a series of motors that can apply torques to a wrist about the three axes of wrist rotation: pronation/supination, flexion/extension, and adduction/abduction. In some modes, a wrist attachment can deliver assistance torques to a subject (i.e., torques that assist a subject in moving the wrist in the desired way). In other modes, a wrist attachment can deliver resistance torques (i.e., torques that oppose a desired motion, as a way of building strength) or perturbation forces. A controller, such as a programmed computer, may direct the actuation of various motors to execute a rehabilitation or training program. A wrist attachment can be combined with a shoulder/elbow motion device in order to provide coordinated therapy for a subject's upper extremity. The disclosed attachments can also be used to correlate wrist motion to brain activity, to study wrist movement control, as telerobotic interfaces, and as general interfaces such as high-performance joysticks for aerospace industry. These applications are described in greater detail below.

Figure 1:
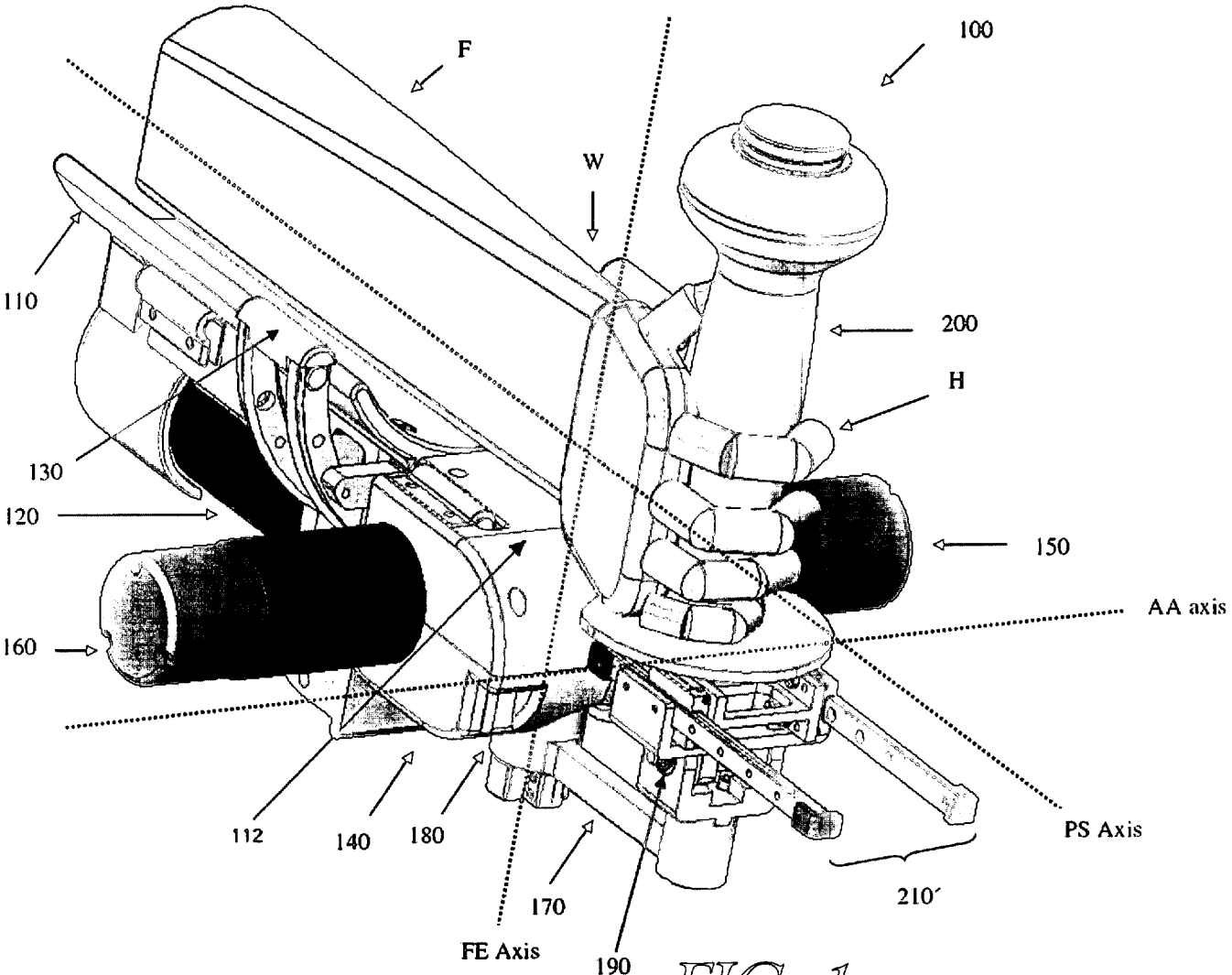
FIG. 1 depicts an embodiment of a wrist attachment in perspective.

FIG. 1 depicts an exemplary embodiment of a wrist attachment 100. A subject's forearm (F), wrist (W), and hand (H) are shown in position on the attachment. The forearm F rests on the forearm support 110, the wrist W rests on the wrist support 112, and the hand H rests on the handle 200. The handle may also include a palm stop (not shown) to help prevent rotation of the hand around the handle. The forearm support may be so sized and shaped as to be able to receive the forearm of a subject from above without obstruction. For example, the depicted embodiment has no structure above the forearm support, so that a patient's forearm can be lowered directly onto the forearm support without having to navigate the forearm around structural elements. This non-obstructed configuration facilitates forearm placement and can reduce the mounting time compared to other systems. The wrist attachments shown in FIGS. 4A-C of U.S. Pat. No. 5,466,213, by contrast, have labyrinthine arrangements that make patient positioning a difficult and time-consuming challenge. In practice, it can take as much as half of a typical one-hour therapy session to position and later remove a patient from the wrist attachments in U.S. Pat. No. 5,466,213, while a non-obstructed arrangement shown here can reduce positioning time significantly.

A wrist attachment may also include several motors and linkages in order to apply various torques to a wrist that is positioned in the wrist attachment. The attachment may include a pronation/supination (PS) motor 120. The PS motor can be mounted to the forearm support 110 in the depicted embodiment, but this is not necessary. The PS motor may be coupled to a PS ring 130 so that the PS ring rotates in a PS plane (shown in FIGS. 3-5) and about a PS axis (shown in FIG. 1) in response to actuation by the PS motor. As the names suggest, the PS motor and PS ring impart torques to pronate and supinate an attached wrist. The wrist attachment may also include a differential mechanism 140 for imparting flexion/extension and abduction/adduction torques. The differential mechanism may be housed inside wrist support 112. The differential mechanism is described in greater detail with reference to FIGS. 6 and 7 and elsewhere. The differential mechanism may be mounted or otherwise coupled to the PS ring, so that the differential mechanism is carried by the PS motor. Alternatively, the actuators can be disposed on serial linkages. A wide variety of actuators may be used. In some embodiments, brushless servomotors may be preferred due to their potential for higher torques, lower speeds, and better heat dissipation. The wrist position and motion can be measured by keeping track of the rotation states of the actuators. Rotational state feedback for the controller can be provided by incremental optical encoders mounted on each motor shaft. Encoders should be mounted without overconstraint in order to preserve the encoder signal.

Figure 2:
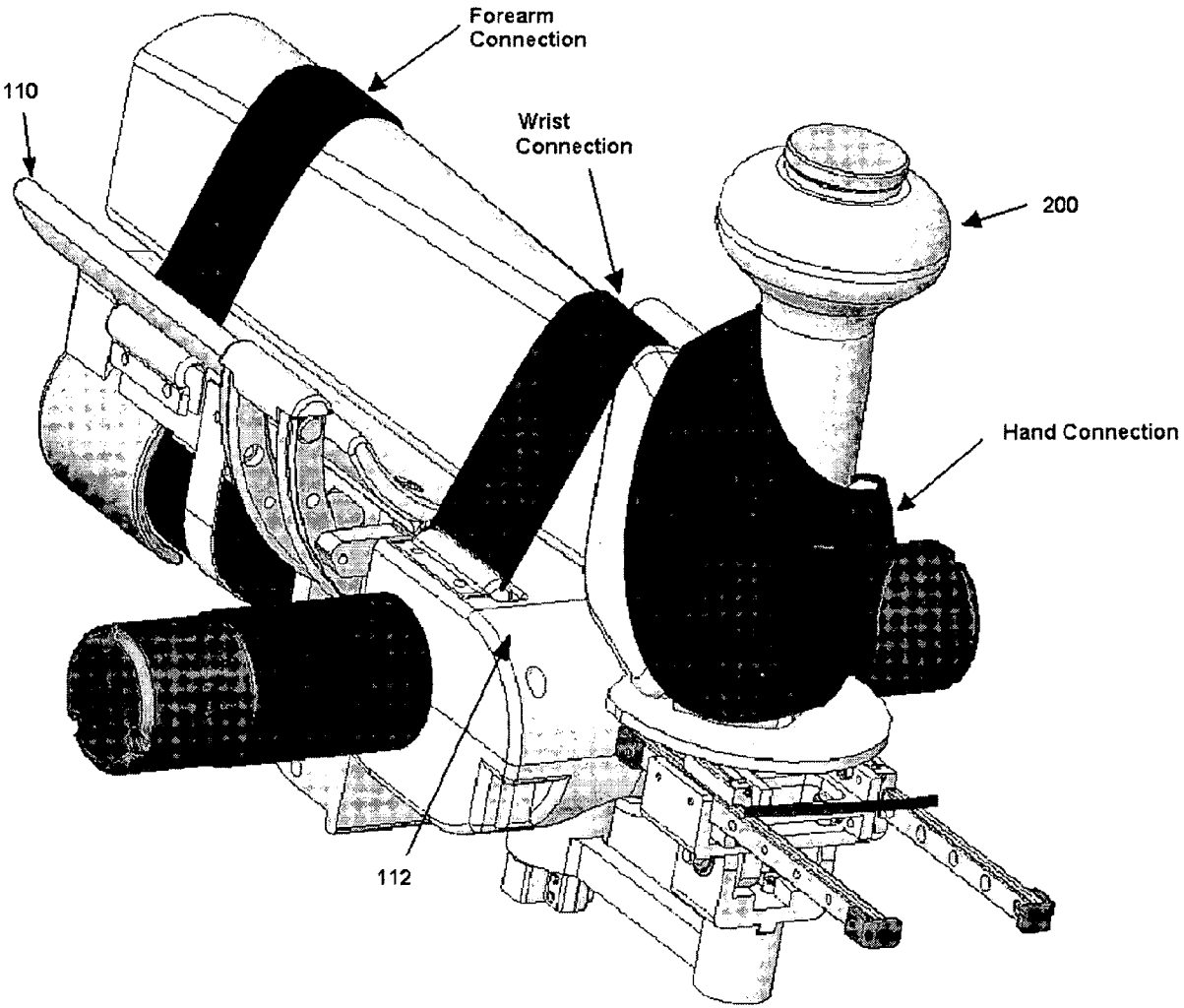
FIG. 2 depicts a wrist attachment with straps.

The differential mechanism acts on an arm 170 that is coupled to the differential mechanism at joint 180. As discussed in greater detail below, the differential mechanism can cause the arm to rotate with two degrees of freedom: tilting up and down and swinging from side to side. These two degrees of freedom allow the wrist attachment to transmit abduction/adduction torques and flexion/extension torques, respectively, to an attached wrist. The arm may be coupled by pivot 190 and slider 210 to the handle 200. The pivot 190 on which the slider 210 is mounted allows a single degree-of-freedom of rotation about an axis perpendicular to both the long axis of the arm and the long axis of the handle. The slider may include one, two, or more arms to increase stability. A wrist attachment may also include various straps, buckles, or other restraining devices to help keep a subject's forearm, wrist, and/or hand safely secured. FIG. 2 shows an exemplary embodiment of a wrist attachment that includes forearm, wrist, and hand connections in the form of straps.

FIG. 1 also shows three principal axes of motion for a wrist attachment. The pronation/supination (PS) Axis extends parallel to the long axis of the device and is the axis about which the PS slide ring may rotate. Rotation of the device about the PS axis will cause or result from pronation and supination of the subject's wrist. The flexion/extension (FE) axis extends through the subject's wrist, the differential mechanism 140, and joint 180 perpendicular to arm 170. Rotation of the device about the FE axis will cause or result from flexion and extension of the subject's wrist. The abduction/adduction (AA) axis extends perpendicular to the FE axis and perpendicular to the arm 170 and passes through the differential mechanism 140. Rotation of the device about the AA axis will cause or result from abduction and adduction of the subject's wrist. The wrist attachment arm rotates about the AA axis, while the subject's wrist rotates about a different axis parallel to the AA axis, because the wrist W, of course, cannot be located in the same place as the arm 170. Slider 210 and pivot 190 allow for the misalignment of these axes as will be described in greater detail with reference to FIG. 12.

FIG. 2A shows exemplary connections used to attach the forearm, wrist and hand to the wrist attachment. The forearm connection may be a strap which loops around the forearm directly above the elbow and secures it to the forearm support 110. The wrist connection may be a strap which loops around the wrist proximal to the AA and FE axis and secures it to the wrist support 112. The hand connection may be a strap that wraps around the thumb and fingers and secures the hand to the handle 200.

Figure 3:
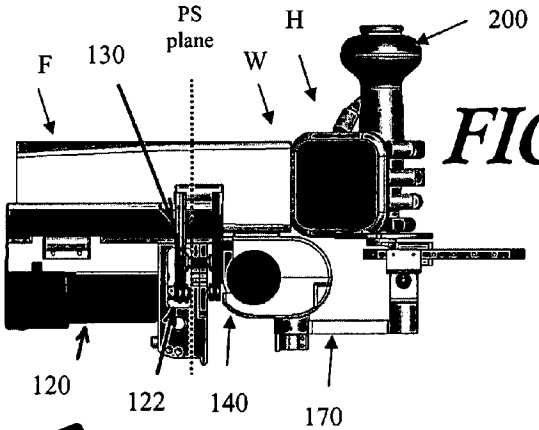
FIG. 3 depicts a portion of a wrist attachment in side elevation.
Figure 3A:
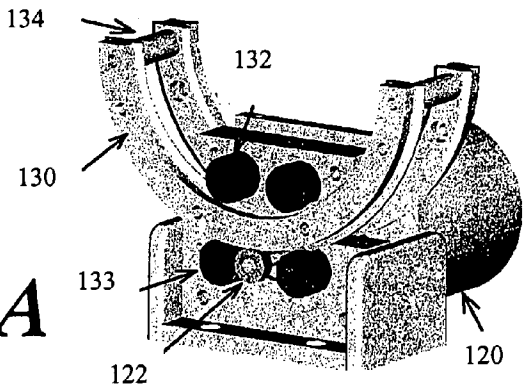
FIG. 3A depicts one embodiment of a pronation-supination transmission.
Figure 5:
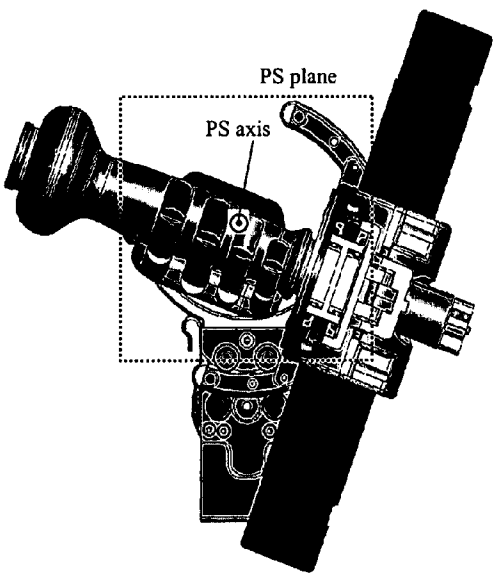
FIGS. 4 and 5 depict two orientations of a wrist attachment about a pronation-supination axis in front elevation.
Figure 4:
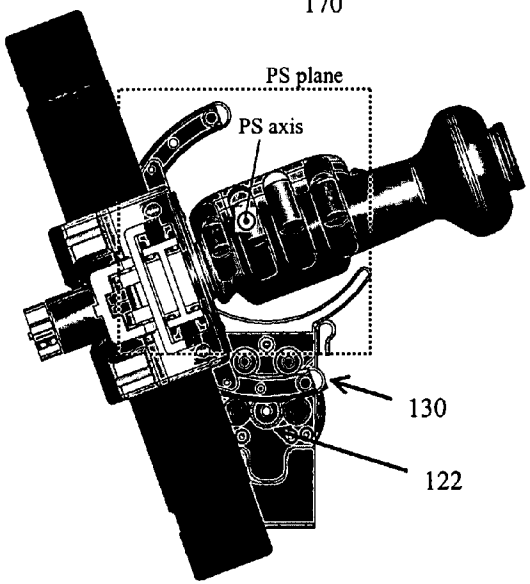
Figure 7:
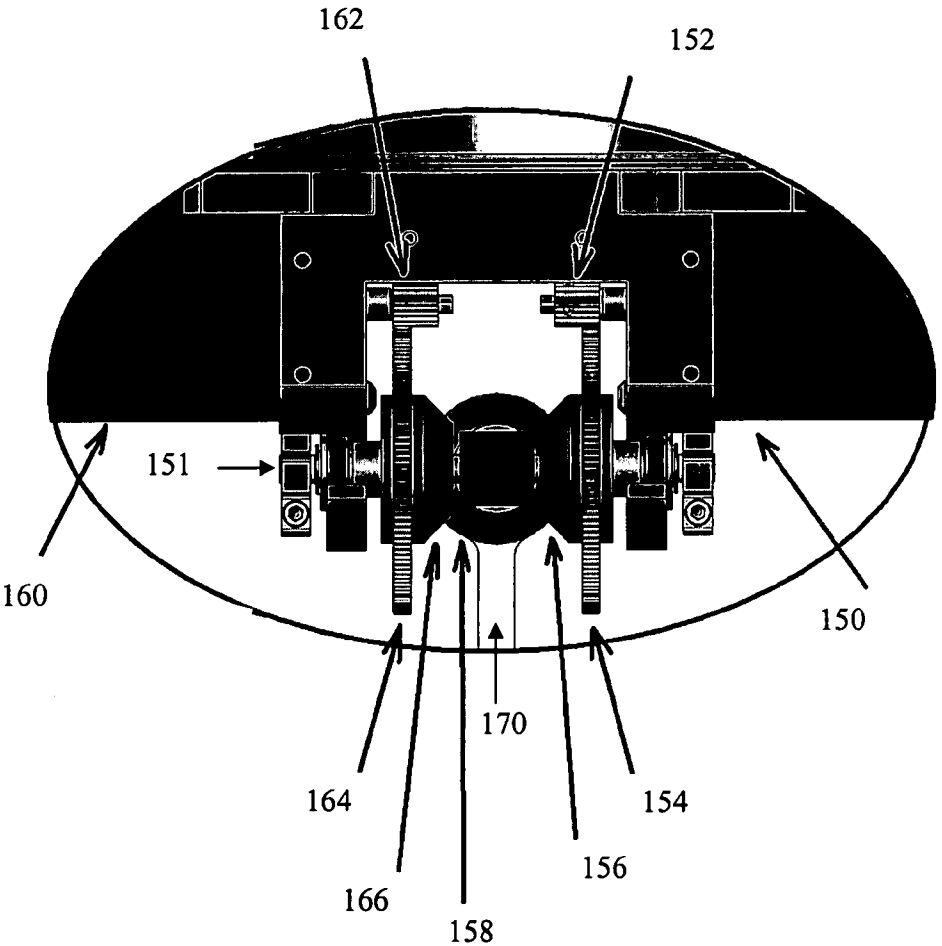
FIG. 7 depicts detail from FIG. 6.
Figure 6:
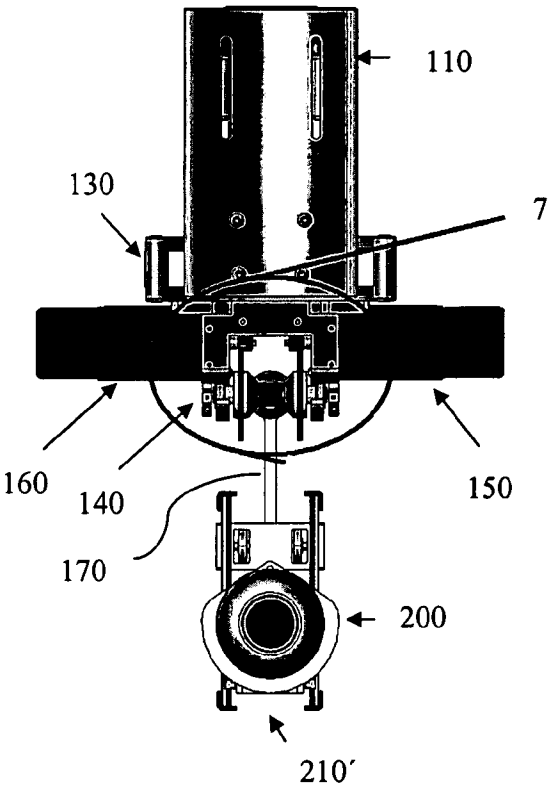
FIG. 6 depicts a portion of a wrist attachment in top plan view.
Figure 9:
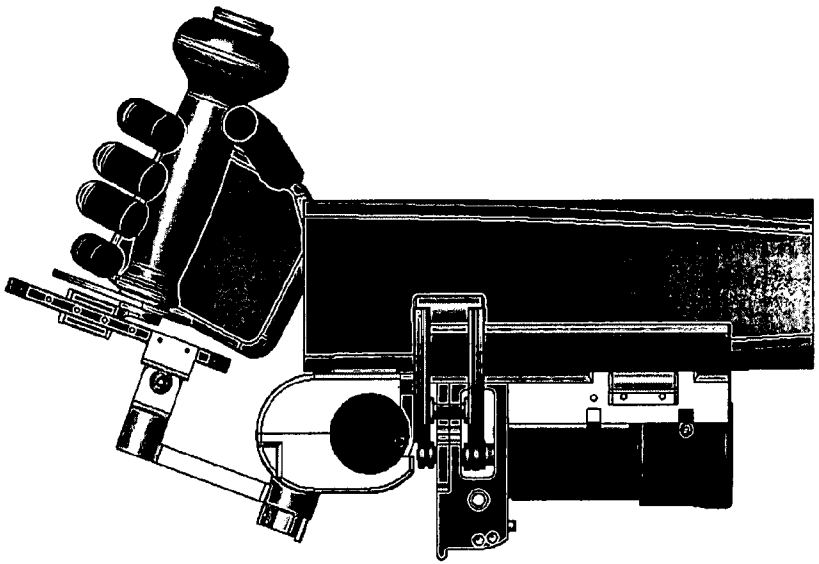
FIGS. 8 and 9 depict two orientations of a wrist attachment about an abduction-adduction axis.
Figure 8:
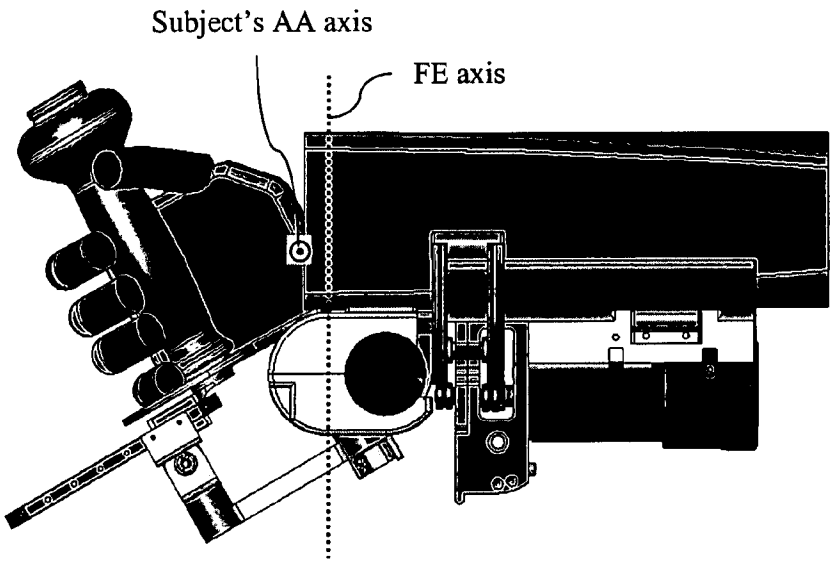
Figure 11:
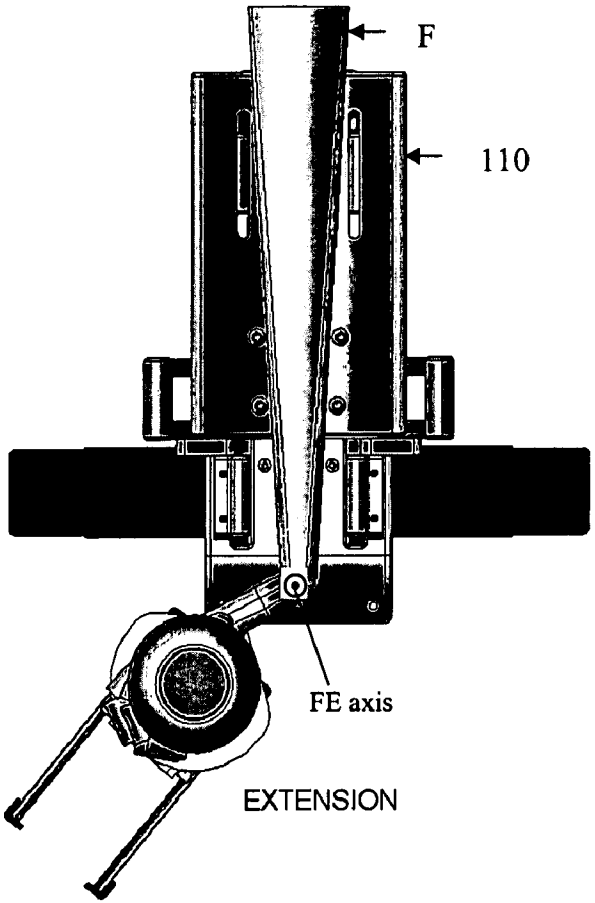
FIGS. 10 and 11 depict two orientations of a wrist attachment about a flexion-extension axis.
Figure 10:
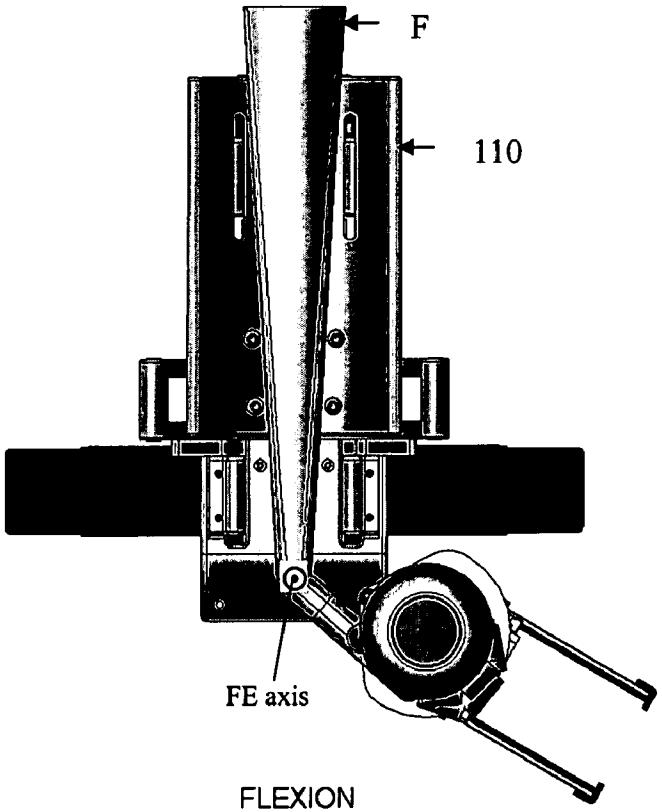

As noted above, the three principal movements of the wrist attachment are (1) pronation/supination (i.e., flipping the wrist over as if twisting a corkscrew), (2) flexion/extension (bending the hand toward or away from the palm, respectively), and (3) abduction/adduction (tilting the hand toward the thumb or toward the little finger, respectively). The wrist attachment is capable of exerting torques on the subject to assist, perturb or resist these movements. FIGS. 3-3A shows one embodiment of the motor and linkage for applying pronation/supination, and FIGS. 4-5 show the attachment and subject in prone and supine orientations, respectively. FIGS. 6-7 show an embodiment of the differential mechanism for the other two movements. FIGS. 8-9 show the attachment and subject in adducted and abducted positions, respectively, while FIGS. 10-11 show the attachment and subject in flexed and extended orientations, respectively.

As shown in FIG. 3, a wrist attachment may include a PS motor 120. The motor may be mechanically coupled to a PS slide ring 130. The coupling can take any of a variety of forms, including, for example, a capstan drive, a belt drive, or a friction drive. In an embodiment, the slide ring can be formed from two Bishop Wisecarver 180° geared slide rings. The rings may sit in a bearing block that includes concentric guide wheels, eccentric guide wheels, and one or more pinion gears. In the depicted embodiment, the PS motor is connected to a pinion 122 which drives one or more gears, such as an integral gear, in the slide ring 130. FIG. 3A shows one embodiment of a PS transmission in greater detail. The PS slide ring 130 is mounted in a gearing block that may include concentric guide wheels 132, eccentric guide wheels 133, and pinion 122. The gear ratio between the motor pinion and the ring gear in one embodiment may be 10.5. The slide ring may include stops 134 to limit the range of pronation for safety and/or to prevent the ring from being decoupled. When the PS motor is actuated, the slide ring 130 swings through an arc in the PS plane (shown edge-on in FIG. 3 and face-on in FIGS. 4-5). The slide ring carries with it differential mechanism 140, arm 170, and handle 200, thereby exerting a torque on the subject about the PS axis (shown in FIGS. 4-5). If the wrist attachment is being operated in a monitoring mode (i.e., sensing position, velocity, and/or force exerted by the subject), then a subject's twisting of handle 200 about the PS axis creates a torque that is transmitted through arm 170 and differential mechanism 140 to PS slide ring 130. Torques can also be transmitted to the slide ring by the wrist connection shown in FIG. 2A.

Figure 7A:
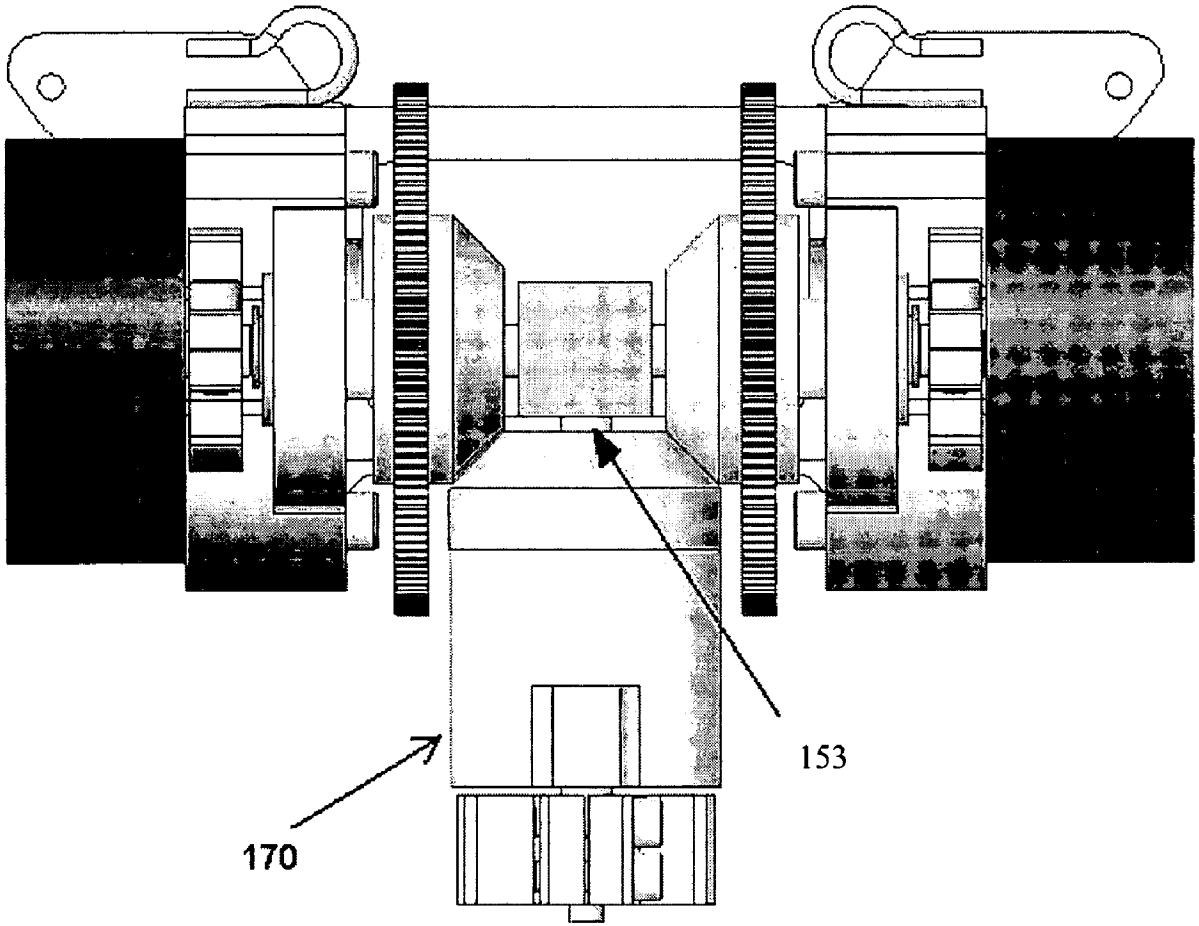
FIG. 7A shows the same portion of detail as in FIG. 7 but in front elevation view.

Torques about the other two principal axes are generated by first and second differential motors 150, 160 acting through a differential mechanism, shown in more detail in FIGS. 6, 7, and 7A. FIG. 6 shows a top plan view of a wrist attachment, with an optional housing for the differential mechanism 140 removed to reveal an embodiment of a gear system in the differential mechanism. FIG. 7 shows detail of the gear system. First and second differential motors 150, 160 drive the geared differential mechanism. In this embodiment, each motor drives respective endgears 154, 164 through respective pinions 152, 162. The gear ratio between the pinion gears on the AA/FE motors and the end gears on the differential in one embodiment may be 7. The endgears are rigidly attached to respective endbevel gears 156, 166, which can rotate about the main differential shaft 151. The coupling between the motor shaft and the endbevel gears may include, for example, a capstan drive, a belt drive or a friction drive. The endbevel gears drive a spider bevel gear 158. The spider bevel gear is free to rotate on the spider gear shaft 153 shown in FIG. 7A, which is a front elevation view of the differential mechanism. The spider gear shaft 153 is rigidly connected and perpendicular to the main differential shaft 151. In one embodiment the endbevel gears and the spider gears may be miter gears and have a gear ratio of 1:1. When both the first and second differential motors turn in the same direction, the spider gear is tilted back or forth, so that the arm 170 is actuated in adduction (FIG. 8) or abduction (FIG. 9). When the first and second differential motors are turned in opposite directions, the spider gear rotates on the spider gear shaft, so that arm 170 is actuated in flexion (FIG. 10) or extension (FIG. 11). This relationship is reflected in the expressions relating motor angles and torques to the orientation and torque on the robot arm:

$$\theta_{long} = \frac{\tilde{\theta}_R + \tilde{\theta}_L}{2}$$

$$\theta_{lat} = \frac{\tilde{\theta}_R - \tilde{\theta}_L}{2}$$

$$\tau_{long} = \tilde{\tau}_R + \tilde{\tau}_L$$

$$\tau_{lat} = \tilde{\tau}_R - \tilde{\tau}_L$$

where $\theta_{long}$ and $\theta_{lat}$ are the longitude and latitude of the robot arm, $\tilde{\theta}_R$ and $\tilde{\theta}_L$ are the rotation of the right and left differential end gears referenced to a neutral handle position (Sign convention holds that clockwise rotation of the motors is positive), and $\tau_{long}$, $\tau_{lat}$, $\tilde{\tau}_R$ and $\tilde{\tau}_L$ are the corresponding torques. During use, a subject's wrist may be positioned over the spider gear, so that $\theta_{long}$ is equal to the angle of wrist flexion. Abduction/adduction is accommodated for through the handle kinematics; the handle is attached to the robot arm through a linear ball slide guide whose rack can pivot. The entire handle mechanism and subject can be viewed as a planar four-bar linkage and is discussed in more detail with reference to FIG. 12. This four bar mechanism results in a one-to-one mapping between $\theta_{lat}$ and wrist abduction/adduction, with the precise relationship determined by the geometry of the patient.

Figure 9A:
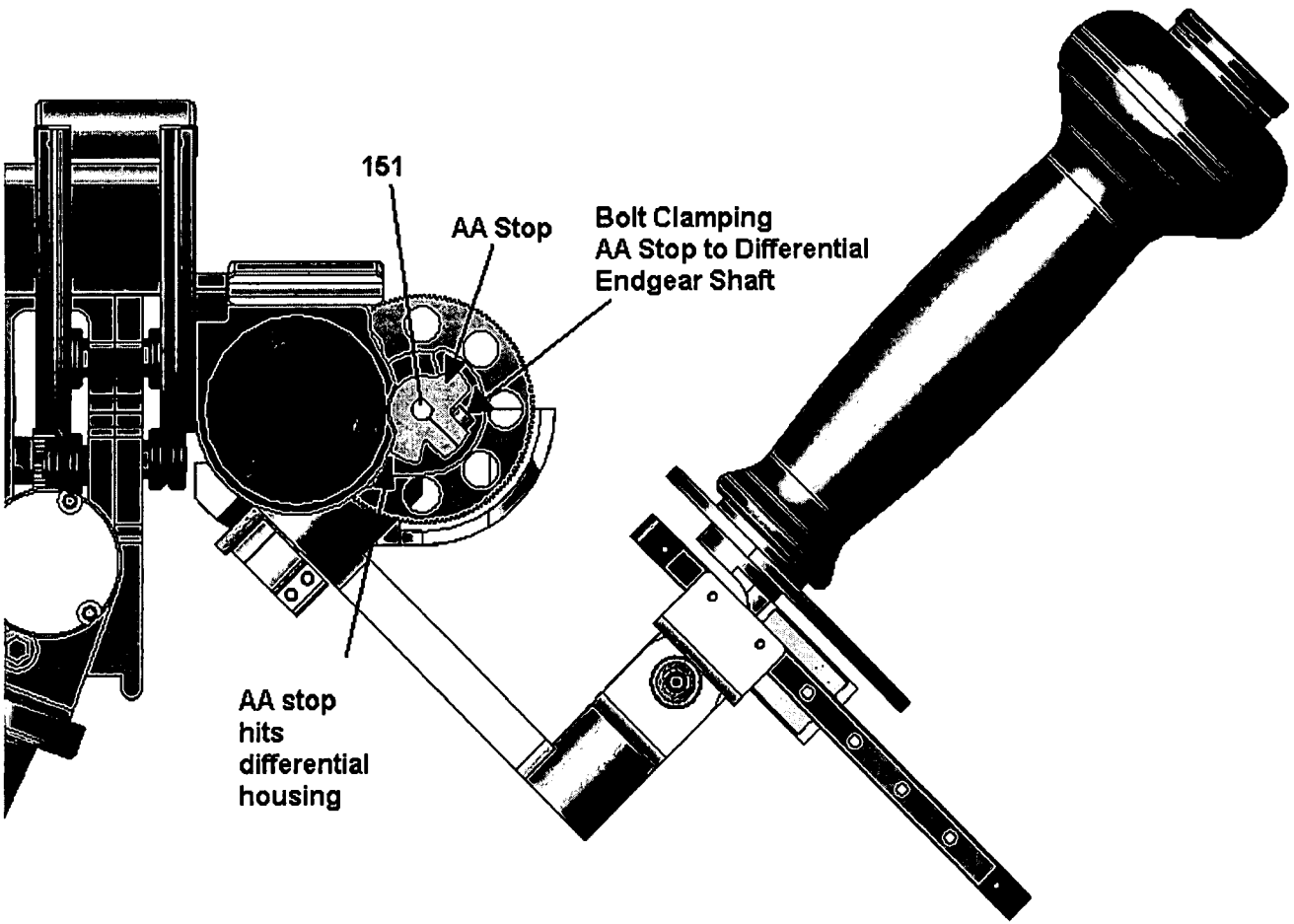
FIG. 9A depicts a side elevation view of a portion of a wrist attachment that includes a stop to limit motion about the abduction-adduction axis.
Figure 11A:
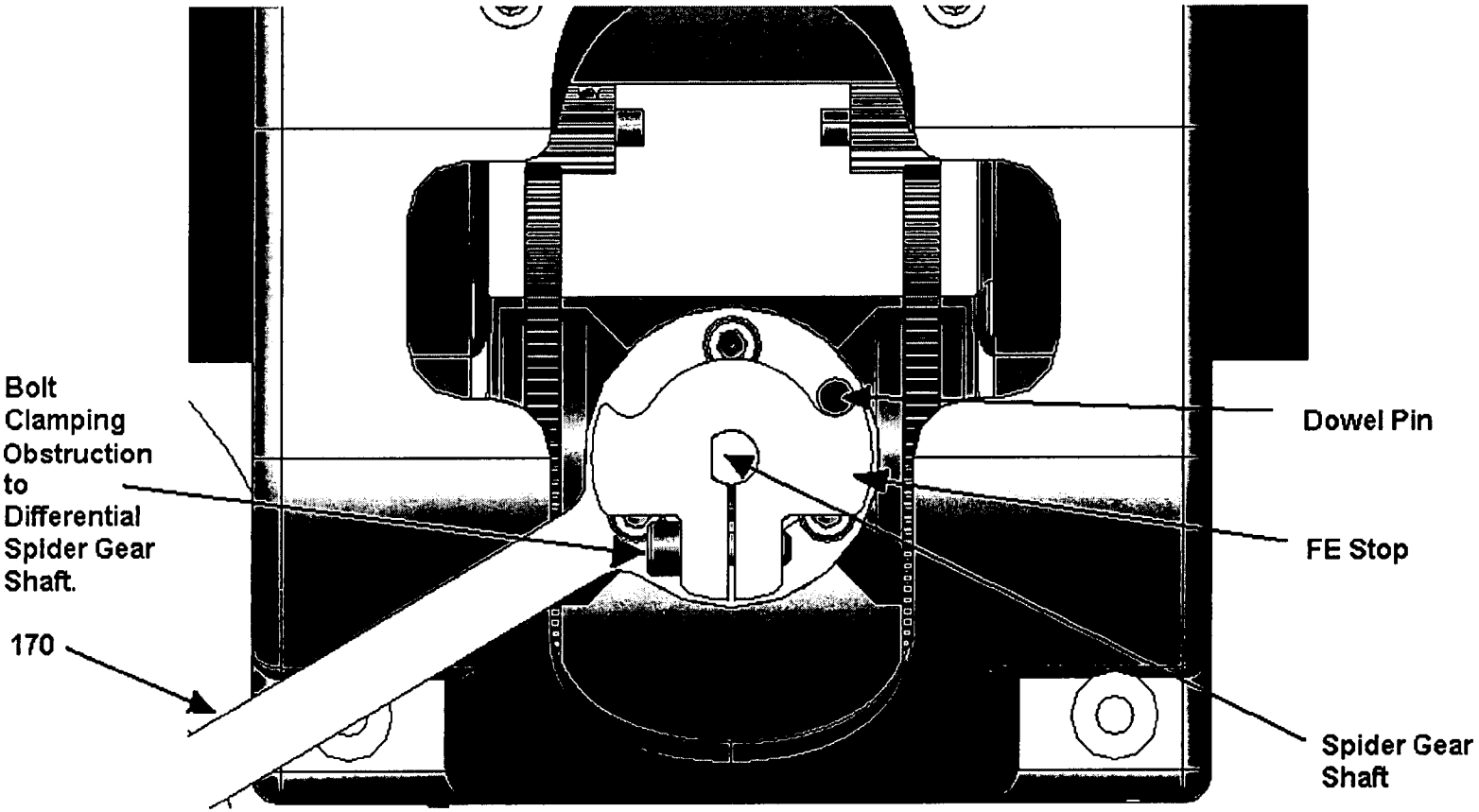
FIG. 11A depicts a bottom plan view of a portion of a wrist attachment that includes a stop to limit motion about the flexion-extension axis.

Motion of the gears may be restricted by including stops on one or more shafts. For example, a radially extending stop may be attached to a gear shaft. The stop may have sufficient dimensions that it impinges on a housing or other transmission structure if its corresponding shaft attempts to rotate too far. Such limitation can provide a measure of safety. Exemplary embodiments of stops are shown in FIGS. 9A and 11A. FIG. 9A shows a stop to limit rotation about the AA axis. The AA stop may be clamped to the main differential shaft 151 so that it turns with AA motion. Contact with the differential housing may limit AA motion to whatever range is selected depending on the shape of the stop. The depicted stop embodiment limits AA motion to about 30 degrees in abduction and 45 degrees in adduction. FIG. 11A depicts a stop to limit rotation about the FE axis. In this embodiment, a stop is mounted to the spider gear shaft 153, and a dowel pin is attached to arm 170. The stop is sized and shaped so that it catches the dowel pin if flexion or extension is attempted beyond a limit determined by the shape of the stop. In the depicted embodiment, the stop can limit FE rotation to about ±60 degrees.

Figure 12:
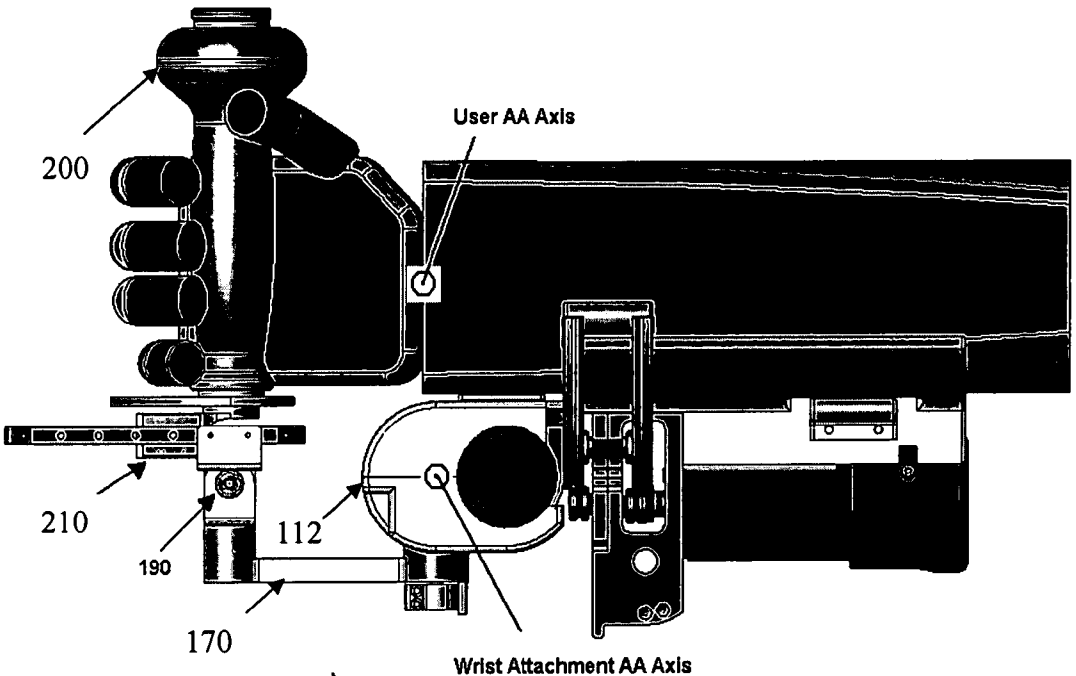
FIGS. 12-12E depict several embodiments of wrist attachment handles and corresponding kinematic diagrams.
Figure 12A:
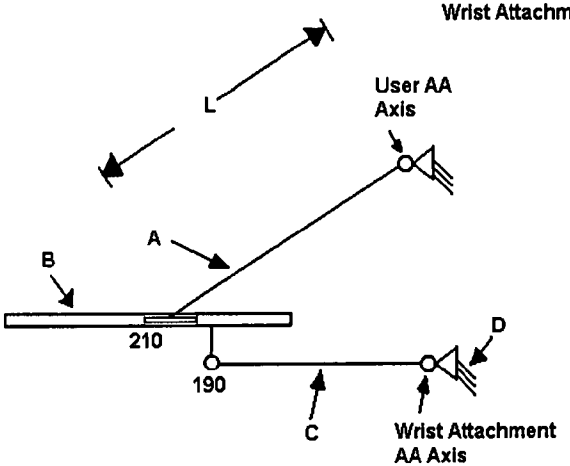

FIG. 12 shows a subject positioned in the wrist attachment and illustrates the joints of the four bar mechanism mentioned above. A schematic diagram of the four bar mechanism is shown in FIG. 12A. The joints in the four bar mechanism are the user AA axis, the slider 210, the pivot 190 and the wrist attachment AA axis. The four links of the four bar mechanism are labeled A, B, C and D in FIG. 12A. Link A includes the subject's hand, the handle, and the slider carriage. Link B includes the slider rail(s). Link C includes arm 170. Link D includes the differential housing 112. The four bar mechanism allows different subject geometries to be accommodated in a single wrist attachment. In FIG. 12, the slider 210 allows the length L of link A to vary. This allows the device to accommodate hands of various sizes.

Figure 12B:
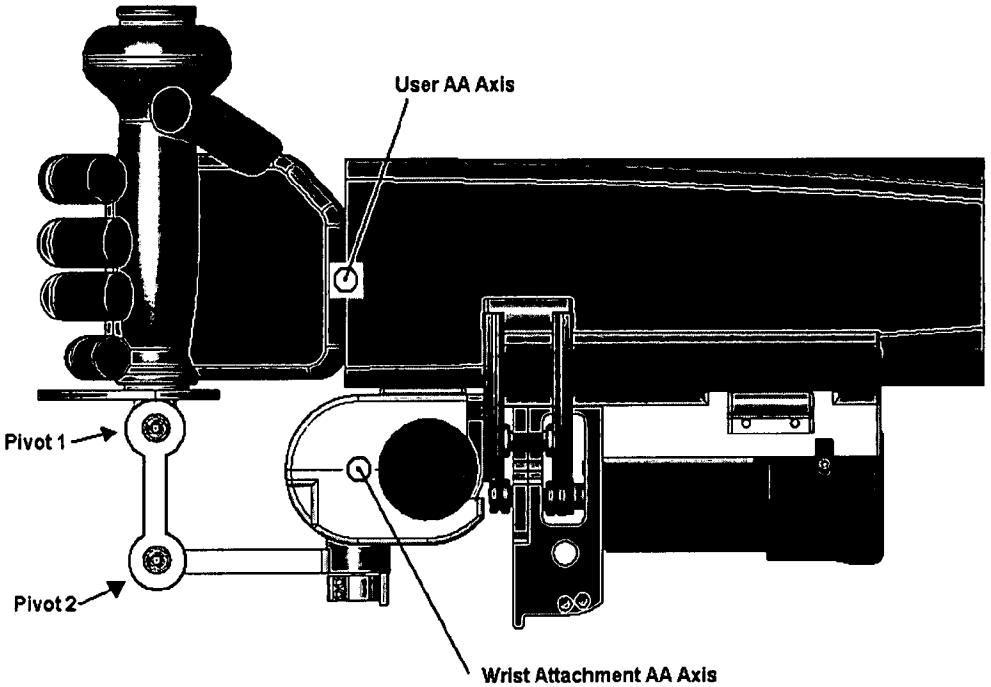
Figure 12C:
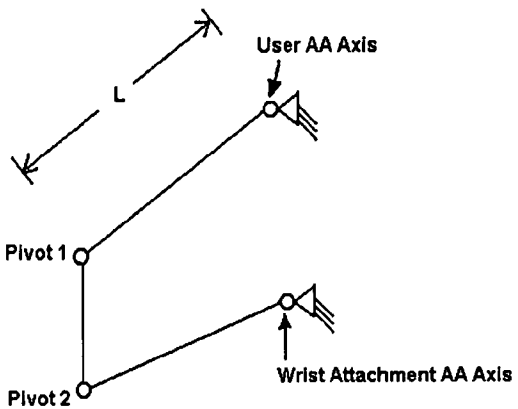
Figure 12D:
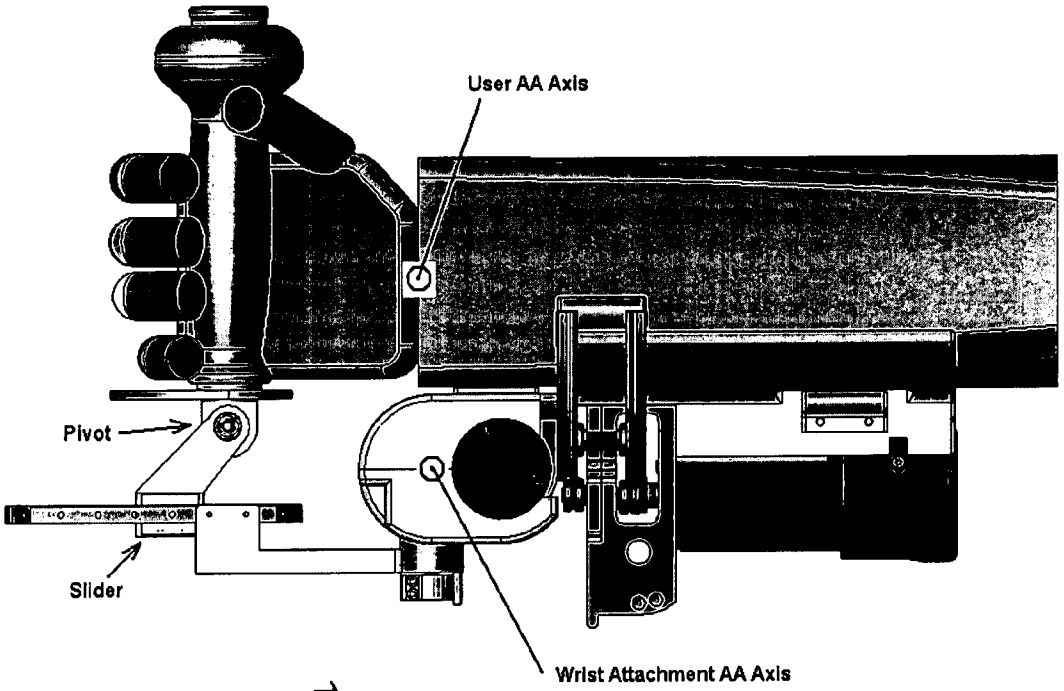
Figure 12E:
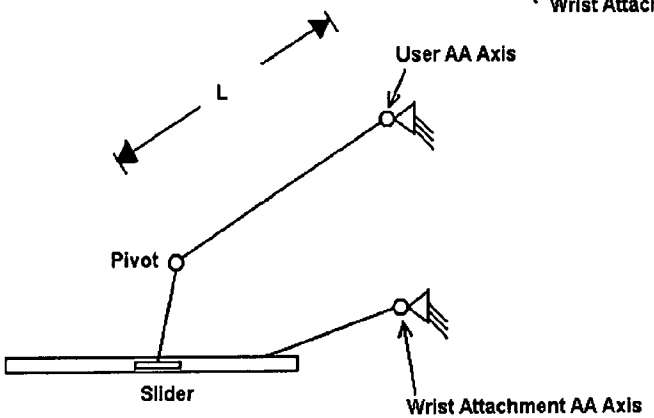

FIGS. 12B-E show alternative embodiments of four bar kinematics. FIG. 12B-C replace the slider of FIG. 12 with a pivot. FIG. 12D-E reverse the order of the slider and pivot from FIG. 12. Each of these kinematics allow for variation in the patient size because the four bar mechanisms are still functional with different L (hand) lengths.

Wrist attachments can use impedance control to guide a subject gently through desired movements. If a patient is incapable of movement, the controller can produce a high impedance (high stiffness) between the desired position and the patient position to move the patient through a given motion. When the user begins to recover, this impedance can gradually be lowered to allow the patient to create his or her own movements. Wrist attachments built according to the teachings herein can achieve stiffnesses of 220 Nm/rad in FE and AA and 1200 Nm/rad in PS. They can achieve maximum damping of 1.14 Nms/rad in FE and AA and 3.72 Nms/rad in PS.

Wrist attachments can also be made mechanically back-drivable. That is, when an attachment is used in a passive mode (i.e. no input power from the actuators), the impedance due to the mechanical hardware (the effective friction and inertia that the user feels when moving) is small enough that the user can easily push the robot around. In some embodiments, the mechanical impedance is $5.6 \cdot 10^{-3}$ kg m$^2$ or less; the static friction is 0.157 N·m or less. Using force or torque feedback, the mechanical impedance can be further reduced.

Figure 13:
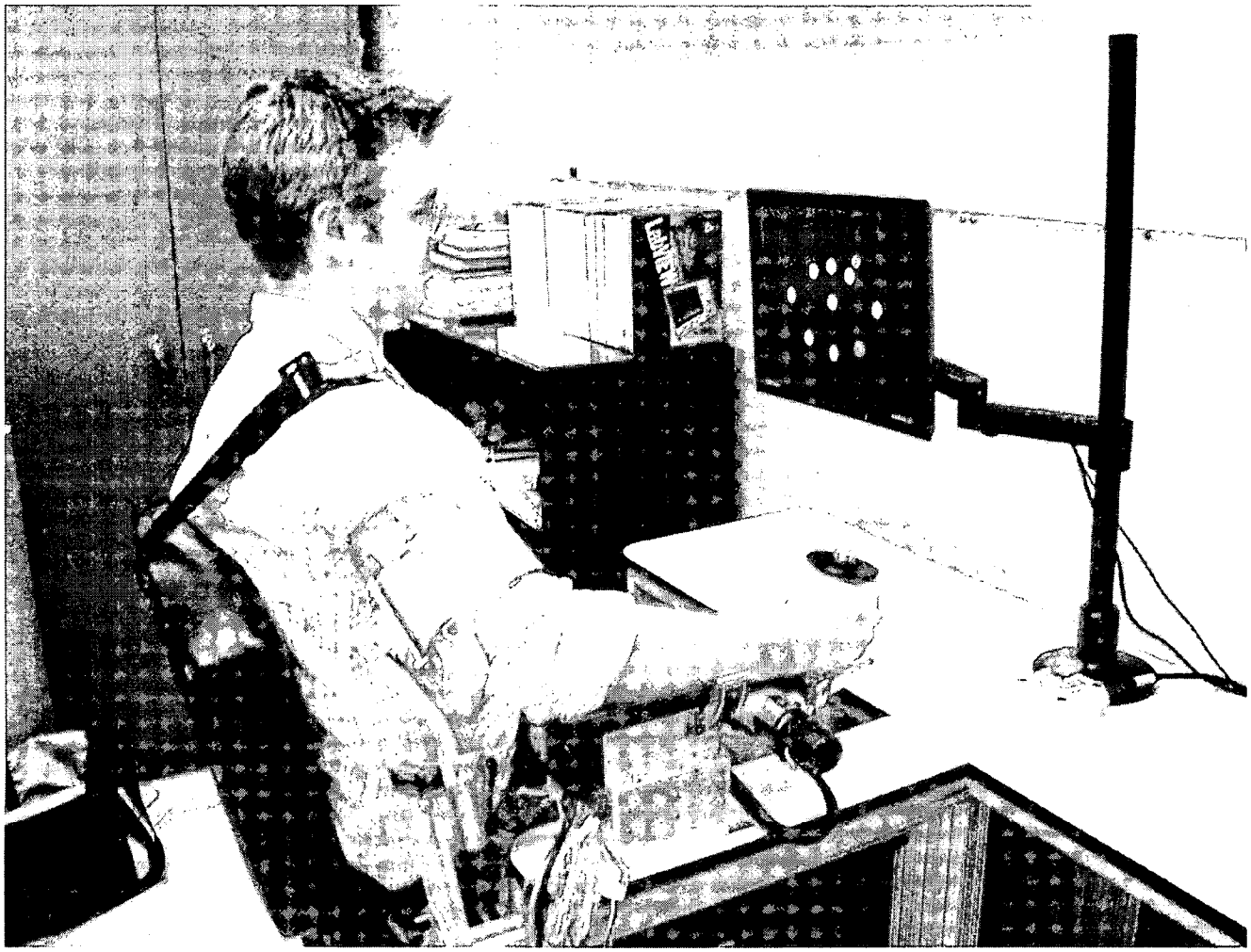
FIG. 13 illustrates a standalone wrist attachment assembly in use.
Figure 14:
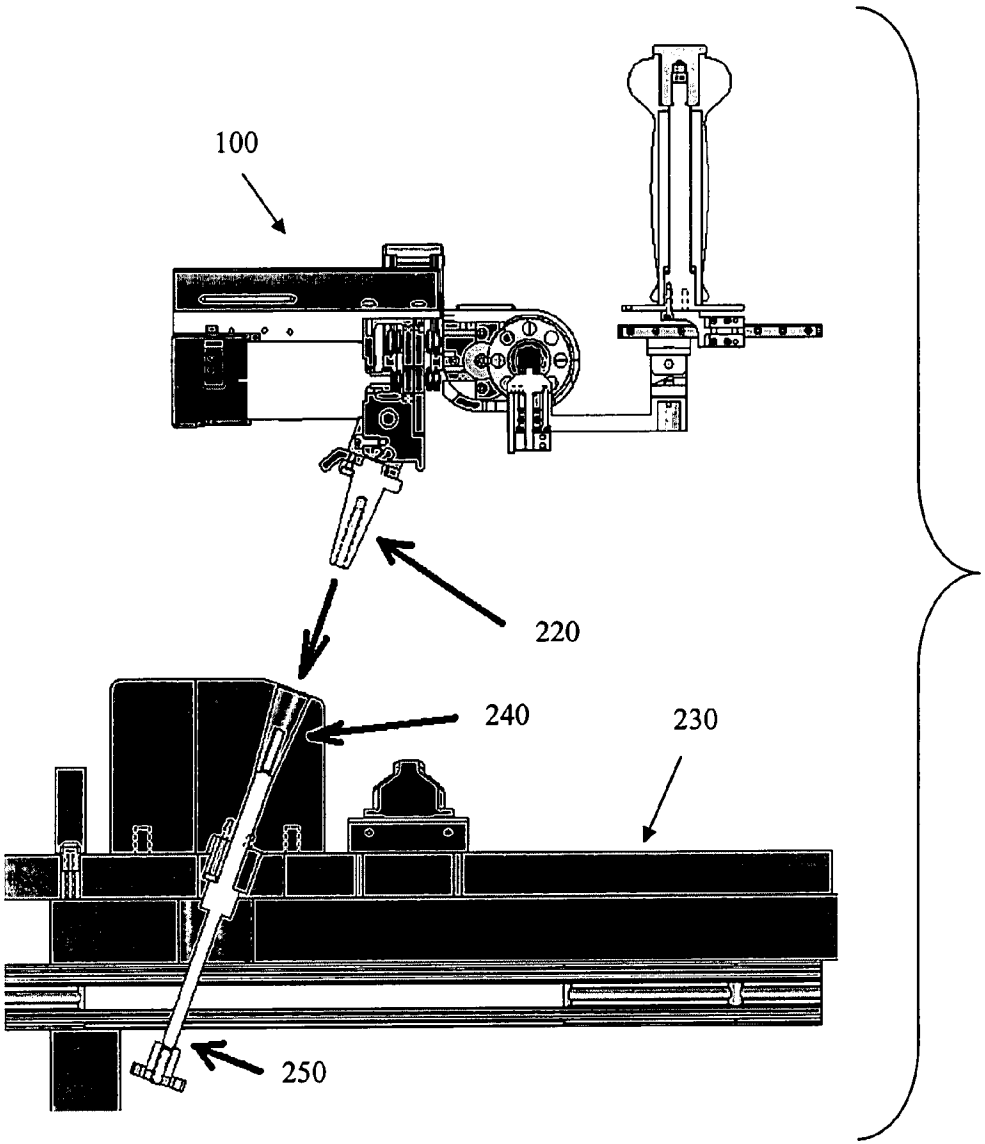
FIG. 14 depicts an exploded view of a standalone wrist attachment assembly.

As discussed above, a wrist attachment can be used as a standalone device to provide therapy and/or measure wrist movements. FIG. 13 is a picture of a subject with forearm and wrist positioned on a standalone wrist attachment that is secured to a fixed base (in this case, a desk). The fixed based may also include additional braces to help position and stabilize the subject, such as the depicted arm brace. If an arm brace is provided, a forearm connection (FIG. 2) can be excluded; excluding the forearm connection can allow unencumbered rotation of the ulna over the radius bone during pronation and supination. FIG. 14 shows another embodiment of a standalone wrist attachment assembly. The wrist attachment 100 can include a connector that can be mated to a complementary connector on a fixed base. In the illustrated exemplary embodiment, the wrist attachment includes conical shaft 220 which fits into fixed base 230 at conical receptacle 240 and is secured by attachment bolt 250. Of course, a wide variety of connectors and complementary connectors are envisioned.

Alternatively, a wrist attachment may be combined with a shoulder/elbow motion device to form an upper extremity attachment. The upper extremity attachment can provide coordinated therapy for the wrist, elbow, and shoulder. Such combined therapy may have significant advantages over therapy devices for only one joint, because a combined therapy device will be more effective in recapitulating the complex and coordinated upper extremity movements of normal activity.

Figure 15:
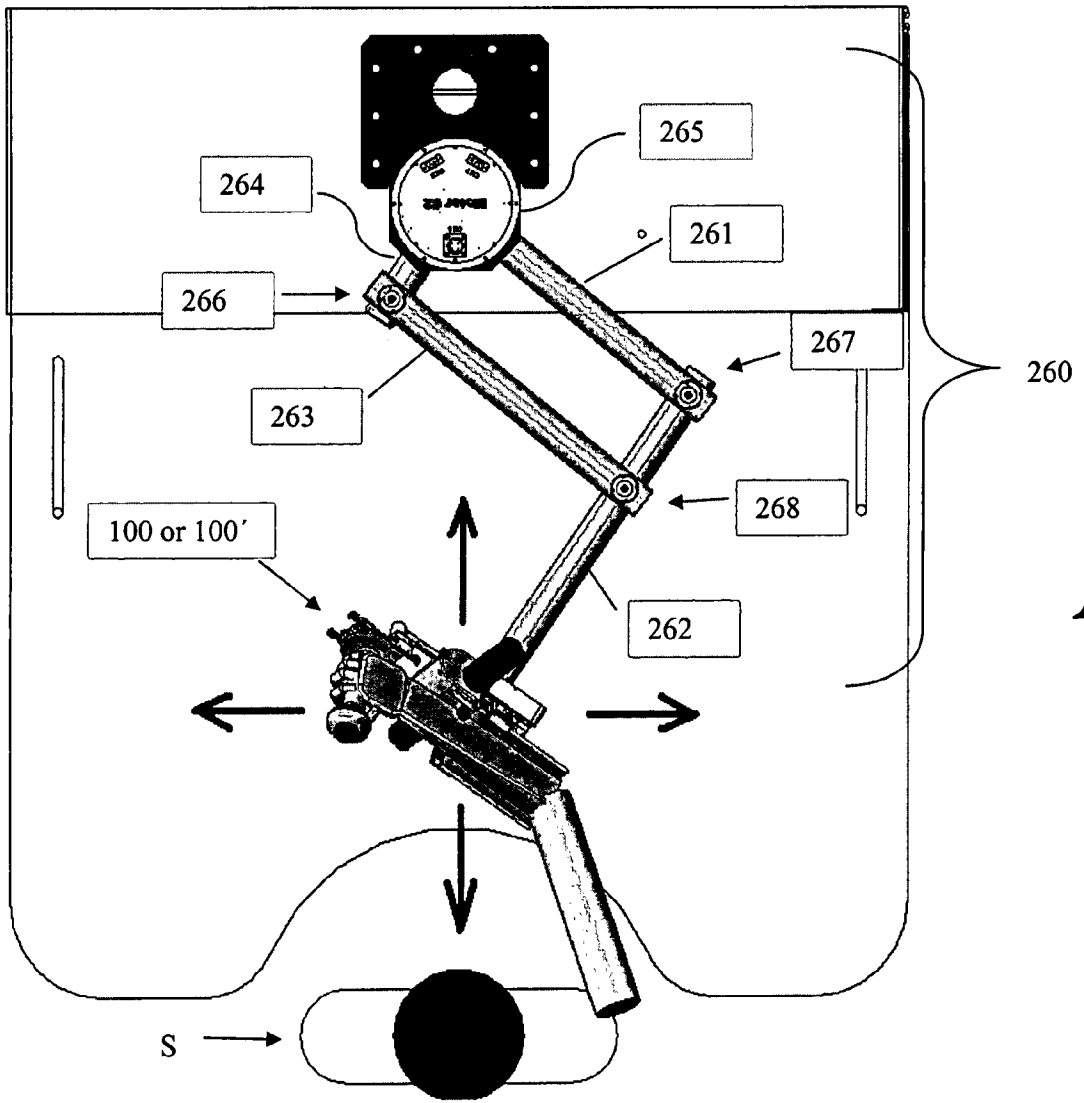
FIG. 15 depicts an embodiment of an upper extremity attachment.

FIG. 15 shows one embodiment of an upper extremity attachment. A wrist of subject S may be positioned on a wrist attachment 100 as described above. The wrist attachment itself is coupled to a shoulder/elbow motion device 260. Shoulder/elbow motion devices are described extensively in U.S. Pat. No. 5,466,213 to Hogan et al, the contents of which are hereby incorporated herein by reference. The shoulder/elbow motion device may include arm member 261, forearm member 262, third member 263, and fourth member 264. The arm member may be coupled at its distal end to the proximal end of the forearm member by an elbow joint 267. The arm member and the forearm member may be rotatable with respect to one another about the elbow joint. The third member may be coupled at its distal end to a position along the midshaft of the forearm member by an elbow actuation joint 268. The third member and the forearm member may be rotatable with respect to one another about the elbow actuation joint. The fourth member may be coupled at its proximal end to the proximal end of the arm member by a shoulder joint 265. The fourth member and the arm member may be rotatable with respect to one another about the shoulder joint. The fourth member may also be coupled at its distal end to the proximal end of the third member by a fourth joint 266, and the third member and the fourth member may be rotatable with respect to one another about the fourth joint. The four members may be oriented in a plane and be moveable in that plane. In some embodiments, the four members are rotatable in only that plane.

The shoulder/elbow motion device may also include a shoulder motor coupled to one of the joints and controlling motion of the shoulder joint. The shoulder/elbow motion device may further include an elbow motor coupled to one of the joints and controlling motion of the elbow actuation joint. The motors are not shown in FIG. 15, but in the depicted embodiment, both motors are located at shoulder joint 265. Locating the motors far from the end point can reduce inertia of the device. In some embodiments, the motors may be aligned along a vertical axis so that the effects of their weight and that of the mechanism is eliminated.

Figure 15B:
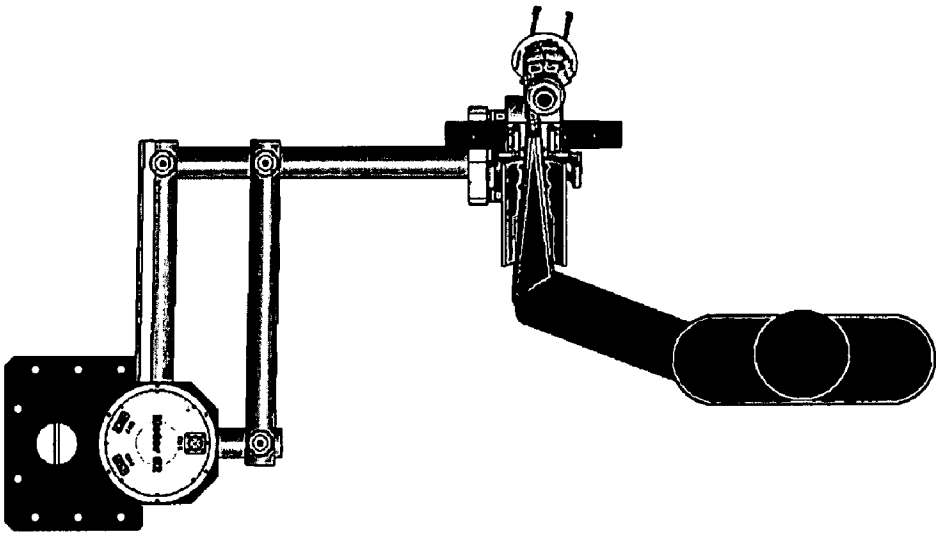
FIGS. 15A-B show alternative orientations upper extremity attachments with respect to a subject.
Figure 15A:
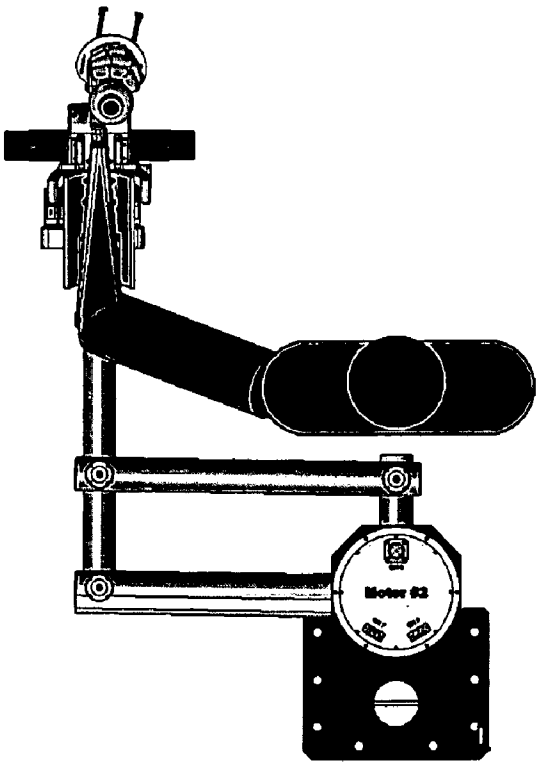

The embodiment of FIG. 15 positions the shoulder/elbow motion device in front of the subject, but other positions are also possible. For example, FIG. 15A shows the shoulder/elbow motion device behind the subject, while FIG. 15B shows it to the subject's side.

Figure 16:
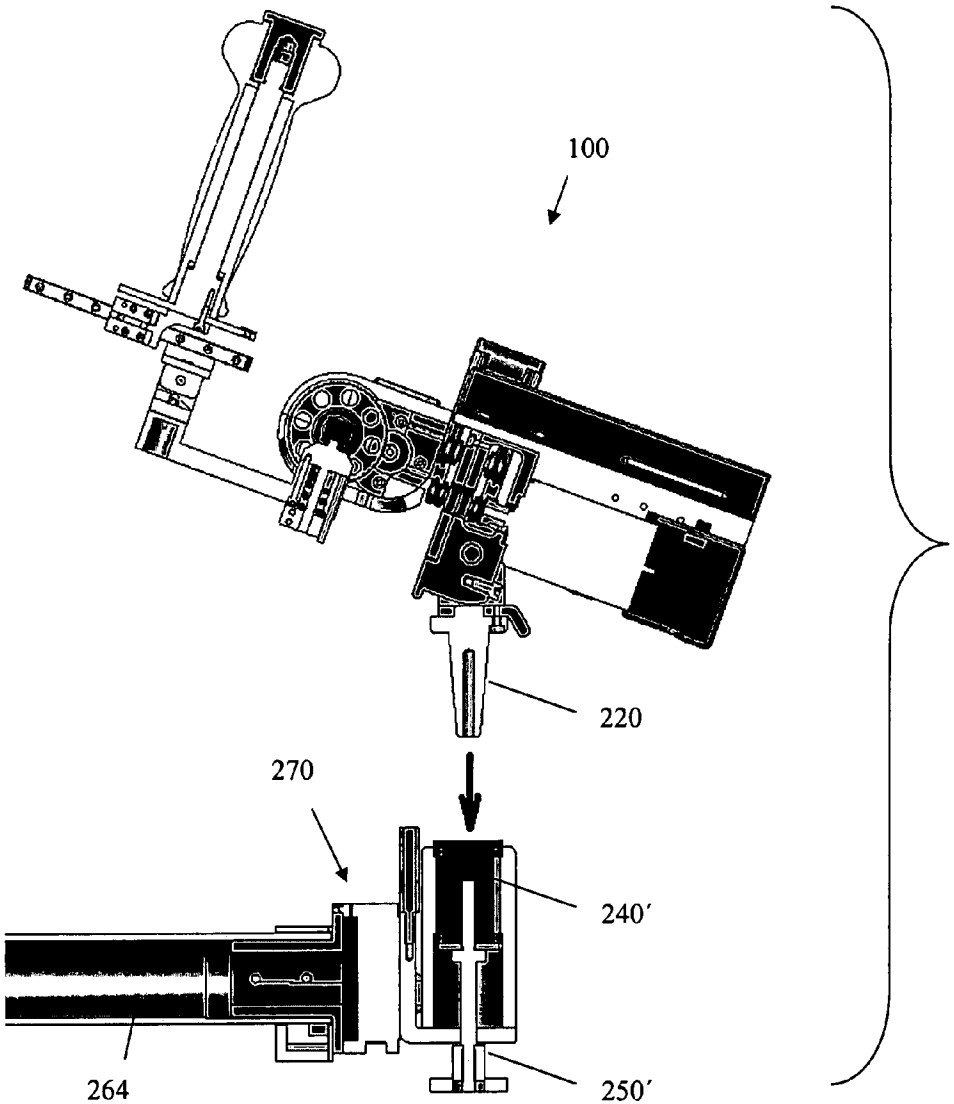
FIG. 16 depicts an exploded view of an upper extremity attachment.
Figure 16A:
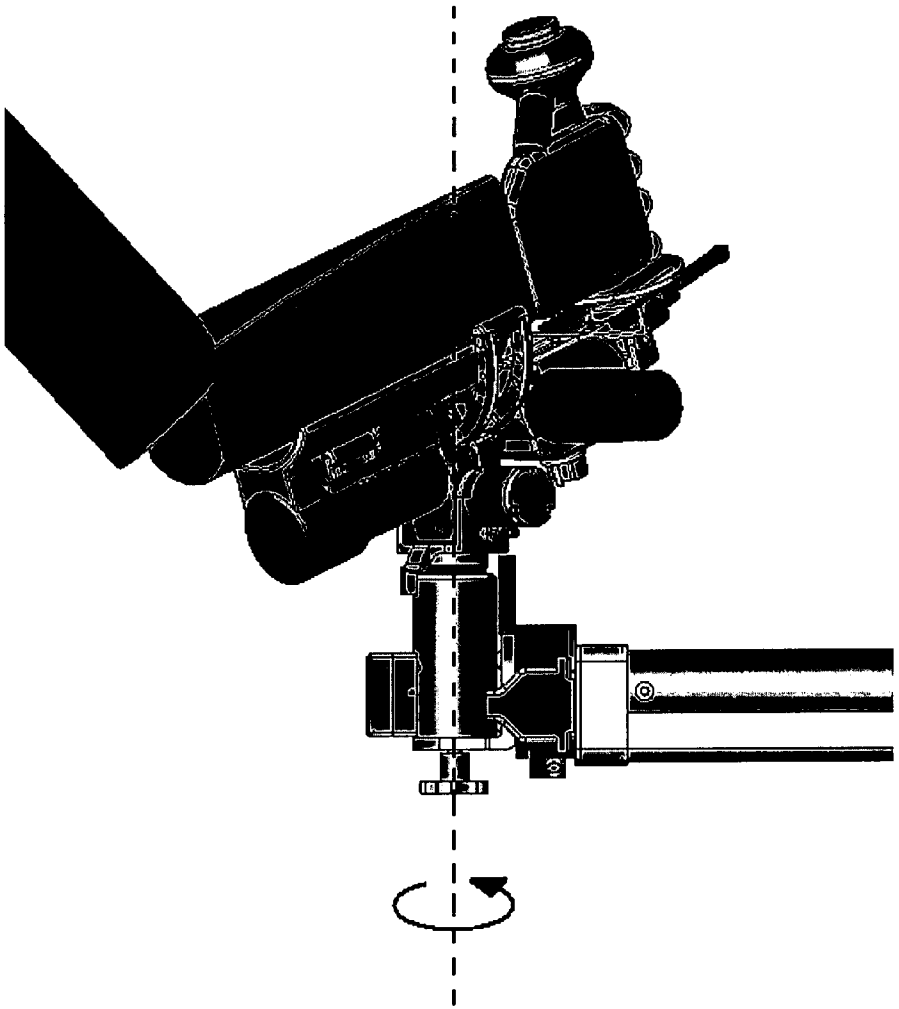
FIG. 16A shows a pivot assembly in more detail.
Figure 18:
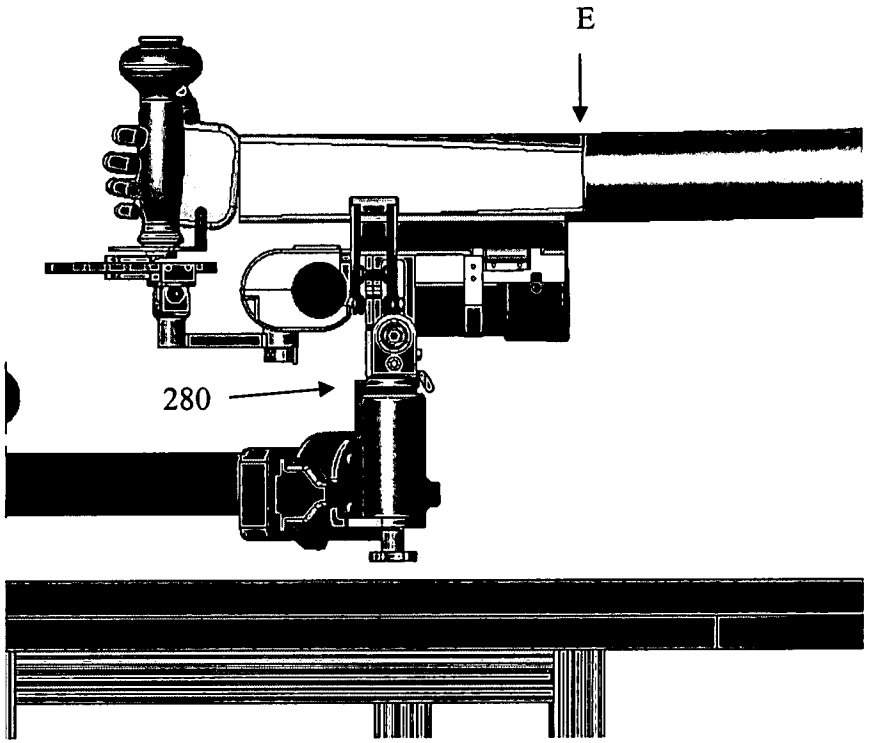
FIGS. 17 and 18 depicts two orientations of an upper extremity attachment about a pivot point.
Figure 17:
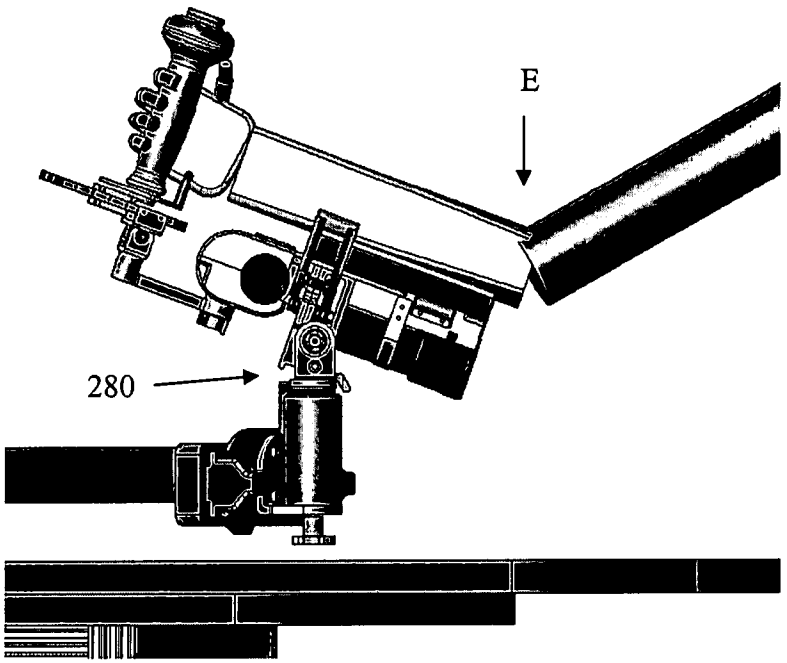

FIG. 16 shows an exemplary embodiment of a connection between a wrist attachment and shoulder/elbow motion device. Analogous to the standalone embodiment, a wrist attachment may include a connector, and the shoulder/elbow motion device may include a complementary connector. In the depicted embodiment, wrist attachment 100 includes conical connector 220, and the shoulder/elbow motion device includes a receptacle 240' attached to the end of forearm member 264, along with an attachment bolt 250'. The shoulder/elbow motion device may also include a first pivot at the distal end of the forearm member 262 which allows the wrist attachment to rotate about the forearm "yaw" axis shown in FIG. 16A. As shown in FIGS. 17-18, the connection between a wrist attachment and a shoulder/elbow motion device may also include a second pivot 280 that allows a subject's arm to flexed or extended at elbow E, in order to allow for forearm pitch when extending the arm. One or both pivots may include a locking mechanism to prevent pivoting motion when the wrist attachment is used as a standalone device. The pivot lock may also be used with the integrated device to hold a subject's arm up against gravity in the case that the subject is too weak to do so unaided. One or both pivots may be coupled to sensors to permit the measurement of forearm yaw and/or pitch.

As mentioned above, wrist and upper extremity attachments can be used in a wide variety of applications. Two broad categories of uses are actuating and sensing. In actuating modes, the devices impart torques on a user's wrist or upper extremity. These torques can be assistive (that is, helping a user move the wrist or upper extremity in the way the user wishes or is directed), or they can be resistive (that is, making it harder for a user to move the wrist or upper extremity in the way the user wishes or is directed) or they can perturb the limb in a precisely controllable manner to facilitate scientific investigation of how the brain controls limb movement. Actuating modes are particularly well-suited for rehabilitation and training applications, in which a user is attempting to develop accuracy and/or strength in a particular wrist or upper extremity motion. In sensing modes, the devices measure position and/or velocity of the device (and thus of the user), and/or torques exerted by the user on the device. Sensing modes are well-suited for diagnostic, investigational, and training applications, in which a user's performance is being assessed or wrist movements are being compared to other measurements. In many circumstances, a device may operate in both actuating and sensing modes. For example, in a training application, the device controller may direct a user to make a certain motion, monitor the user's ability to make the motion, and cause the device to provide assistive or resistive or perturbation forces in response to the user's voluntary motions.

The wrist is particularly well-suited to describe angular motion because of its several rotational degrees of freedom. As a result, the disclosed wrist and upper extremity attachments can be used as highly sensitive angular orientation and angular velocity sensors. Instead of using one's entire arm (as with many airplane controls) or one's fingers (as with gaming joysticks and some airplane controls) to describe angular motion, the rotational degrees of freedom of the wrist could be used. The kinematics of the disclosed devices allow for this. They allow the user to describe angular motion by simply rotating his or her wrist about its natural axes of rotation. The kinematic design of the disclosed devices includes additional degrees of freedom to accommodate wrist kinematics, which are poorly characterized. With the extra degrees of freedom, the disclosed devices can transmit torques without binding or causing discomfort to the user and also without rendering the combined system of human and machine statically unstable under load. This result is surprising; mechanical design based on the standard model of wrist biomechanics has proved to be unworkable because the actual wrist deviates from assumptions on which the biomechanical ideal is based, including the assumptions that all axes of rotation pass through a single point in the wrist, and that they are unchanging. At the same time the disclosed devices can display human-scale forces and torques substantially larger than can be generated by present haptic display technology or gaming force-feedback joysticks.

Applications of the disclosed devices include:

Use as a wrist rehabilitation robot in rehabilitation hospitals or at home. Presently the neurorehabilitation process is a very labor intensive process. A single patient requires several hours with a physical therapist on a daily basis to regain motor skill. The estimated annual cost for the care of stroke victims is $30 billion. It may also be used to help aid the recovery of patients with arthritis (or other debilitating diseases) or with wrist impairment following surgery. In addition to helping patients recover, the device can be used to collect data on patient movement in a given therapeutic session and over several sessions. This data can help therapists quantify patient improvement and/or identify patient problem areas.

Use as a research tool to study the brain and how it interprets orientation. The device may be used to map wrist activity to brain activity. The robot's computer accurately records the position, velocity and acceleration of the wrist. Using a technology capable of monitoring or imaging the brain, such as EEG (electro-encephalography), PET (positron emission tomography), or fMRI, the relationships between wrist motions and brain activity can be mapped.

Use as a tool for studying biomechanics and psychophysics. It could be used to study how the wrist moves and what its trajectories are in normal movements and tasks. The system can simultaneously record the 3 DOF (three-degree-of-freedom) positions, velocities, forces and accelerations used in these tasks.

Use as a tele-robotic tool. It could be used to describe the orientation of a robot end-effector and could also be used to transmit torques sensed by the robot back to the operator. It could be used to control small manipulators for tele-surgery robots or in robots for dangerous environments (such as space tele-robots).

Use as a 3 degree-of-freedom gaming joystick to describe angular orientation or velocity to a computer. The system can provide a haptic display of human-scale forces and torques to improve game realism or support special effects.

Use as a control device for vehicles, such as airplanes, automobiles, underwater vehicles, and the like.

EXAMPLE

The example given here is provided to illustrate specific embodiments of wrist attachments in order to show with some particularity how a wrist attachment can be constructed. As one familiar with the biomechanical arts will appreciate, a wide variety of options exist in the choice of actuators, sensors, transmissions, materials, etc. that do not bear directly on the inventive aspects of the present disclosure.

Example

Robotic Therapy

The wrist attachment may be incorporated in a workstation, as shown in FIG. 14. The patient may be seated with the robot to the side. The attachment is secured at the hand, wrist, and above the elbow. Attachment above the elbow critically restricts translation of the forearm along its long axis, thereby maintaining the kinematic relation between rotation of the subject's wrist and rotation of the wrist attachment close to a preferred configuration that facilitates transmission of torque and mechanical power between human and machine. The workstation can hold the patient comfortably with around 20° of shoulder abduction and 30° of shoulder flexion. Flexion and abduction can be adjustable. The monitor in front of the patient conveys the orientation of the robot and the desired motions as described below.

Figure 19:
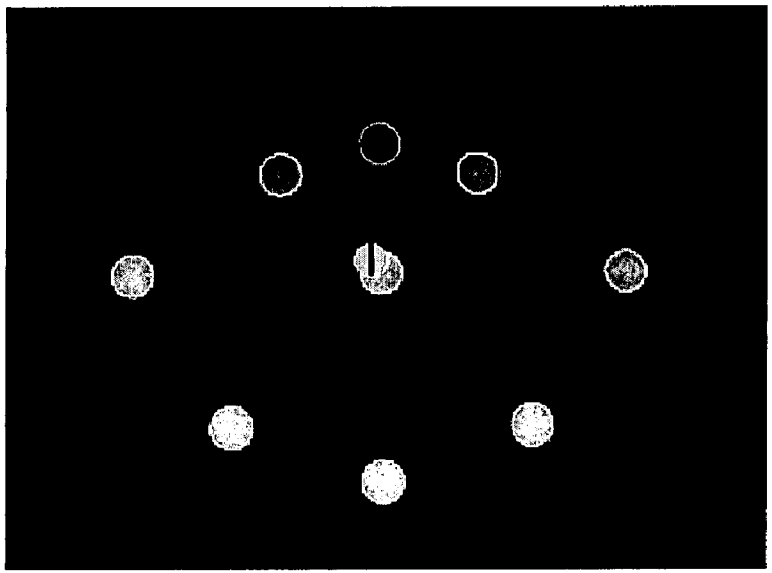

A computer can be programmed to administer "games" to exercise or train various wrist and upper extremity motions. FIG. 19 shows one exemplary game for developing flexion/extension and abduction/adduction movements. A cursor moves on the screen, in response to FE and AA movements by the subject, as the projection of the handle deviation from a neutral position. The subject is prompted to move from target to target by color changes. Target placement accounts for the normal wrist's range of motion in each direction. The line on the cursor represents the angle the wrist sagittal plane makes with the vertical (pronation and supination). As described above, the computer program may instruct the wrist attachment to exert assistive or resistive torques to help or to challenge the subject, as appropriate.

Figure 20:
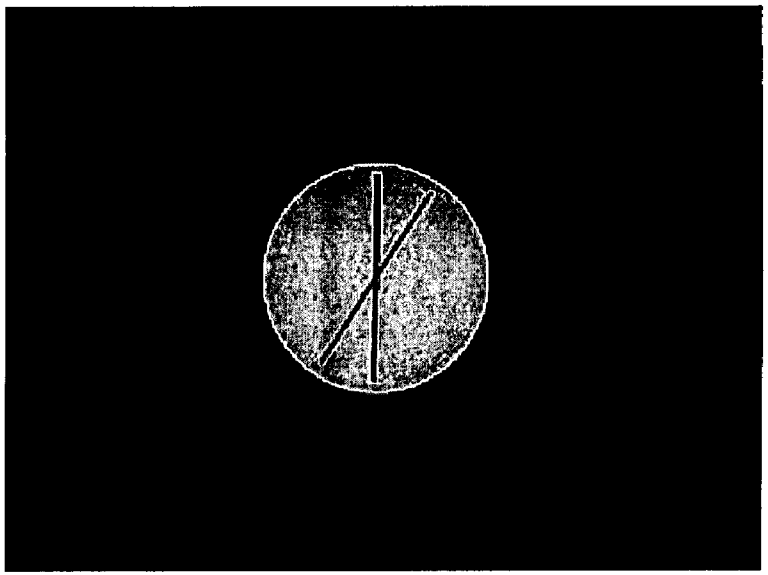
FIGS. 19 and 20 depict exemplary visual displays for training games.

FIG. 20 shows another exemplary game for pronation/supination motions. In this game, the subject is directed to pronate or supinate to an indicated position. These games include moving to specified targets, as well as tracking tasks (sinusoidal) traced out by the target line. The current rotational position and the target position are represented as lines. As the subject pronates or supinates the wrist, the "current position" moves in response.

The controller can record the time history of position, velocity, command torques, and current information (motor torques) as games or other training sessions progress.

The invention claimed is:

1. An upper extremity attachment, comprising:

a shoulder-elbow motion device, comprising:

a member assembly comprising a moveable member having at least one degree of freedom and a distal free end;

a drive system coupled to the moveable member to drive the moveable member, the drive system comprising at least one motor; and a wrist attachment coupled with at least one degree of freedom to the distal free end of the shoulder-elbow motion device and comprising:

a forearm support, so sized and shaped as to be able to receive a forearm of a subject, the forearm support defining a long axis;

a handle so positioned in relation to the forearm support and so sized and shaped as to be able to receive a hand; and a transmission system actuating rotation of the handle with at least three degrees of freedom with respect to the forearm support and comprising a pronation/supination (PS) motor coupled to a PS slide ring, the slide ring being rotatable about a PS axis and in a plane perpendicular to the forearm support long axis.

2. The upper extremity attachment of claim 1, wherein the member assembly comprises:

an arm member coupled at its distal end to the proximal end of a forearm member by an elbow joint, the arm member and the forearm member rotatable with respect to one another about the elbow joint;

a third member coupled at its distal end to the midshaft of the forearm member by an elbow actuation joint, the third member and the forearm member rotatable with respect to one another about the elbow actuation joint; and a fourth member coupled at its proximal end to the proximal end of the arm member by a shoulder joint, the fourth member and the arm member rotatable with respect to one another about the shoulder joint; the fourth member also coupled at its distal end to the proximal end of the third member by a fourth joint, the third member and the fourth member rotatable with respect to one another about the fourth joint.

3. The upper extremity attachment of claim 2, wherein the four members are oriented in a plane and are rotatable in that plane.

4. The upper extremity attachment of claim 1, wherein the drive system comprises:

a shoulder motor coupled to one of the joints and controlling motion of the shoulder joint; and an elbow motor coupled to one of the joints and controlling motion of the elbow actuation joint.

5. The upper extremity attachment of claim 4, wherein the shoulder motor and the elbow motor are positioned along a common vertical axis perpendicular to the plane.

6. The upper extremity attachment of claim 4, wherein the shoulder motor and the elbow motor are coupled to the shoulder joint.

7. The upper extremity attachment of claim 1, wherein the PS slide ring is so mounted to the forearm support as to make the forearm support rotatable with the PS slide ring.

8. The upper extremity attachment of claim 1, wherein the PS motor is mounted to the forearm support.

9. The upper extremity attachment of claim 1, wherein the PS slide ring comprises an integral gear, and the PS motor is coupled to the PS slide ring by a pinion gear engaging the integral gear.

10. The upper extremity attachment of claim 1, wherein the wrist attachment transmission system comprises a differential mechanism, the differential mechanism including:

a first differential motor;

a second differential motor; and a gear system coupling the first and second differential motors to an arm, the arm being rotatable with two degrees of freedom about a flexion/extension (FE) axis and an abduction/adduction (AA) axis substantially perpendicular to the FE axis.

11. The upper extremity attachment of claim 10, wherein the differential mechanism is coupled to the PS slide ring.

12. The upper extremity attachment of claim 10, wherein the differential mechanism gear system comprises:

two endgears, one coupled to each of the first and second differential motors;

each endgear rigidly coupled to a respective endbevel gear; and a spider bevel gear engaging both endbevel gears.

13. The upper extremity attachment of claim 1, wherein the handle has at most two degrees of freedom with respect to the arm of the wrist attachment.

14. The upper extremity attachment of claim 1, wherein the handle is coupled to the forearm support.

15. The upper extremity attachment of claim 1, wherein at least one of the drive system and the transmission system comprises at least one sensor.

16. The upper extremity attachment of claim 15, further comprising one sensor for each degree of freedom.

17. The upper extremity attachment of claim 15, wherein the sensor is a motion sensor.

18. The upper extremity attachment of claim 17, wherein the motion sensor comprises an optical encoder.

19. The upper extremity attachment of claim 15, wherein the sensor comprises a torque and/or force sensor.

20. The upper extremity attachment of claim 1, wherein at least one of the drive system and the transmission system comprises at least one motion sensor and one torque and/or force sensor.

21. An upper extremity motion system, comprising:

an upper extremity attachment as defined by claim 1; and a controller coupled to at least one of the drive system and the transmission system to control actuation of that system.

22. The upper extremity motion system of claim 21, further comprising a sensor coupled to at least one of the drive system and the transmission system and producing an output indicative of a state of the upper extremity motion system, wherein the controller controls actuation of the upper extremity motion system in response to the sensor output.

23. A method of upper extremity training, comprising:

lowering a subject's forearm onto the forearm support of an upper extremity attachment as defined in claim 1;

aligning the subject's wrist flexion axis with the FE axis of the wrist attachment;

contacting the subject's hand to the handle of the wrist attachment;

securing at least one of the subject's upper arm, forearm, wrist, and hand to the wrist attachment; and actuating at least one of the drive system and the transmission system to provide at least one of assistance, perturbation, and resistance to an upper extremity motion.

24. The upper extremity attachment of claim 1, wherein the forearm support is so sized and shaped as to be able to receive the subject's forearm from above without obstruction.

25. A wrist attachment, comprising:

a forearm support, so sized and shaped as to be able to receive a forearm of a subject, the forearm support defining a long axis;

a handle so positioned in relation to the forearm support and so sized and shaped as to be able to receive a hand, the handle having four degrees of freedom with respect to the forearm support; and a transmission system actuating rotation of the handle with three degrees of freedom with respect to the forearm support and comprising a pronation/supination (PS) motor coupled to a PS slide ring, the slide ring being rotatable about a PS axis and in a plane perpendicular to the forearm support long axis.

26. The wrist attachment of claim 25, wherein the forearm support has at most one degree of freedom with respect to a stationary base.

27. The wrist attachment of claim 25, wherein the PS motor is mounted to the forearm support.

28. The wrist attachment of claim 25, wherein the PS slide ring comprises an integral gear, and the PS motor is coupled to the PS slide ring by a pinion gear engaging the integral gear.

29. The wrist attachment of claim 25, wherein the PS slide ring is coupled to the PS motor by at least one of a capstan drive, a belt drive and a friction drive.

30. The wrist attachment of claim 25, wherein the transmission system comprises:

a differential mechanism, the differential mechanism including:

a first differential motor;

a second differential motor; and a gear system coupling the first and second differential motors to an arm, the arm being rotatable with two degrees of freedom about a flexion/extension (FE) axis and an abduction/adduction (AA) axis substantially perpendicular to the FE axis.

31. The wrist attachment of claim 30, wherein the differential mechanism is coupled to the PS slide ring.

32. The wrist attachment of claim 30, wherein the differential mechanism gear system comprises:

two endgears, one coupled to each of the first and second differential motors;

each endgear rigidly coupled to a respective endbevel gear; and a spider bevel gear engaging both endbevel gears.

33. The wrist attachment of claim 30, wherein the differential mechanism gear system comprises:

two end bevel gears coupled to a respective differential motor by at least one of a capstan drive, a belt drive and a friction drive; and a spider bevel gear engaging both endbevel gears.

34. The wrist attachment of claim 30, wherein the handle has at most two degrees of freedom with respect to the arm.

35. The wrist attachment of claim 25, wherein the handle is coupled to the forearm support.

36. The wrist attachment of claim 25, wherein the forearm support is so sized and shaped as to be able to receive the subject's forearm from above without obstruction.

37. The wrist attachment of claim 25, further comprising at least one sensor coupled to the transmission system.

38. The wrist attachment of claim 37, wherein the transmission system comprises one sensor for each degree of freedom.

39. The wrist attachment of claim 37, wherein the sensor comprises an optical encoder.

40. The wrist attachment of claim 37, wherein the sensor comprises a torque and/or force sensor.

41. The wrist attachment of claim 37, further comprising at least one motion sensor and one torque and/or force sensor.

42. A wrist motion system, comprising:

a wrist attachment as defined by claim 25; and a controller coupled to the transmission system to control the actuation of the transmission system.

43. The wrist motion system of claim 42, further comprising a sensor coupled to the transmission system and producing an output indicative of a state of the wrist attachment, wherein the controller controls actuation of the transmission system in response to the sensor output.

44. A method of wrist training, comprising:

lowering a subject's forearm onto the forearm support of a wrist attachment as defined in claim 25;

aligning the subject's wrist flexion axis with the FE axis of the wrist attachment;

contacting the subject's hand to the handle of the wrist attachment;

securing at least one of the subject's upper arm, forearm, wrist, and hand to the wrist attachment; and actuating the transmission system to provide at least one of assistance, perturbation, and resistance to a wrist motion.

45. A wrist attachment, comprising:

a forearm support, so sized and shaped as to be able to receive a forearm of a subject, the forearm support defining a long axis;

a handle so positioned in relation to the forearm support and so sized and shaped as to be able to receive a hand, the handle having four degrees of freedom with respect to the forearm support; and a transmission system actuating rotation of the handle with three degrees of freedom with respect to the forearm support and comprising a differential mechanism, the differential mechanism including:

a first differential motor;

a second differential motor; and a gear system coupling the first and second differential motors to an arm, the arm being rotatable with two degrees of freedom about a flexion/extension (FE) axis and an abduction/adduction (AA) axis substantially perpendicular to the FE axis.

46. The wrist attachment of claim 45, wherein the differential mechanism gear system comprises:

two endgears, one coupled to each of the first and second differential motors;

each endgear rigidly coupled to a respective endbevel gear; and a spider bevel gear engaging both endbevel gears.

47. The wrist attachment of claim 45, wherein the differential mechanism gear system comprises:

two endbevel gears coupled to a respective differential motor by at least one of a capstan drive, a belt drive and a friction drive; and a spider bevel gear engaging both endbevel gears.

48. The wrist attachment of claim 45, wherein the handle has at most two degrees of freedom with respect to the arm.

* * * * *

UNITED STATES PATENT AND TRADEMARK OFFICE

CERTIFICATE OF CORRECTION

PATENT NO. : 7,618,381 B2
APPLICATION NO. : 10/976083
DATED : November 17, 2009
INVENTOR(S) : Krebs et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1330 days.

Signed and Sealed this

Nineteenth Day of October, 2010

David J. Kappos

David J. Kappos
*Director of the United States Patent and Trademark Office*